US012798628B2

(12) United States Patent
Balderson et al.

(10) Patent No.: US 12,798,628 B2
(45) Date of Patent: Nov. 17, 2026

(54) APPARATUS AND METHOD FOR CONVERSION OF LAND BASED MACHINE TO A HIGH-RAIL SYSTEM

(71) Applicant: Dymax, Inc., Wamego, KS (US)

(72) Inventors: Scott E. Balderson, Manhattan, KS (US); John D. Boose, Auburn, KS (US)

(73) Assignee: Dymax, Inc., Wamego, KS (US)

( * ) Notice: Subject to any disclaimer, the term of this patent is extended or adjusted under 35 U.S.C. 154(b) by 353 days.

(21) Appl. No.: 18/629,879

(22) Filed: Apr. 8, 2024

(65) Prior Publication Data

US 2025/0313241 A1 Oct. 9, 2025

(51) Int. Cl.
*B61D 15/00* (2006.01)
*E02F 9/02* (2006.01)

(52) U.S. Cl.
CPC ..... *B61D 15/00* (2013.01); *E02F 9/022* (2013.01)

(58) Field of Classification Search
CPC ..... B61D 15/00; E02F 9/022
See application file for complete search history.

(56) References Cited

U.S. PATENT DOCUMENTS 4,938,643 A * 7/1990 Lamb ..... B61D 3/182 410/1
5,199,344 A * 4/1993 Wagner ..... E02F 3/386 188/41
8,316,774 B1 * 11/2012 Coots ..... B61C 11/00 180/320
8,646,582 B2 * 2/2014 Bourhill ..... B66C 9/18 188/41
10,683,635 B2 * 6/2020 Malmberg ..... B60K 17/10
11,046,536 B2 * 6/2021 Connor ..... B60P 1/43
2008/0053332 A1 * 3/2008 Roy ..... B60F 1/043 105/215.1
2009/0101042 A1 * 4/2009 Foote ..... B61D 15/00 105/215.1
2021/0222374 A1 * 7/2021 Bokenkamp ..... E01B 29/32
2021/0370804 A1 * 12/2021 Zhao ..... B60N 2/015
2022/0388549 A1 * 12/2022 Peterson ..... E01B 29/00
2025/0313241 A1 * 10/2025 Balderson ..... E02F 9/022

FOREIGN PATENT DOCUMENTS

AU 2023266269 A1 * 6/2024 ..... E02F 9/022
CN 102963227 A * 3/2013
CN 203172748 U * 9/2013
CN 106862957 A * 6/2017 ..... B23Q 3/062
DE 102024109788 A1 * 10/2025 ..... B60F 1/00
EP 1925753 A2 * 5/2008 ..... B60F 1/043

* cited by examiner

*Primary Examiner* — Jason C Smith
(74) *Attorney, Agent, or Firm* — Bruce J. Clark

(57) ABSTRACT

A rail drive system for reversibly converting a crawler mobilized machine from ground transport mobility to rail transport mobility where the machine has a rigid X-Frame underneath, rigid enveloping structure provides for releasably engaging the X-Frame in a noninvasive manner retaining the X-Frame securely in a horizontal and vertical direction, and a method is provided for achieving the same. The invention can utilize the hydraulic system of the machine itself to selectively operate all hydraulics of the invention to raise and lower rail systems to allow both ground and rail mobility as desired.

14 Claims, 17 Drawing Sheets

APPARATUS AND METHOD FOR CONVERSION OF LAND BASED MACHINE TO A HIGH-RAIL SYSTEM

BACKGROUND OF THE INVENTION

This invention relates to the field of high-rail systems, in particular, the field of large hydraulic excavators or other crawler mobilized machines, used in the rail industry on rail tracks.

In the rail industry, it is often necessary to use machinery designed for use on land mobilized using crawler tracks to be used on the rails, in addition to the standard use on land. The standard machines are made mobile with tires or crawler tracks.

Excavators, for example, are used on rails for the purpose of building and maintaining the rail beds, clearing in or around rails or other uses. They are often built to travel both on their land-based wheels or crawler tracks, with the ability to switch to rail wheels for moving along the rails.

These combination systems are expensive and time consuming to convert a hydraulic excavator to a dual purpose (land and rail) machine. The conversion requires the substantial modification of the underlying excavator by aftermarket builders, including the modifications or changing of structure and/or OEM (Original Equipment Manufacturer) machine warranties.

Moreover, the changes are permanent to that excavator and thus don't allow a conversion assembly for rails to be easily removed and installed on another excavator of that type.

Furthermore, small machines, such as those with blades or other attachments on the front or rear near the rail level, limit the ability to install front and rear rail wheel apparatus.

Thus, what is needed is a method and apparatus that allows for converting a hydraulic excavator from a solely land mobile system to a land-rail system, and for relatively easily removing the apparatus and installing on another similar excavator while simultaneously leaving the excavator in its original form.

The instant invention provides for utilizing the existing hydraulic manifold of a large hydraulic excavator with no modification to the OEM manifold and without significant modification to the excavator.

Crawler excavators have an X-Frame that is attached to the land mobilizing means of the excavator. Such an excavator, for example, is the PC200 Crawler Excavator made by KOMATSU™ having no front or rear interfering attachments located near the level of the rails. The X-Frame is located below the lower part of the excavator cab, which cab area includes the driver seat and controls, and has connected therewith the hydraulic lever controls and hydraulic manifold. The X-Frame has rotational means that provide the means for the cab to rotate about the mobilizing means. The invention uniquely and easily connects to the X-Frame in a secure and safe manner avoiding any modification to any hydraulic manifold. The manner of the apparatus connection maintains the strength and integrity and thus safety of the excavator and its use.

Thus, the invention further provides for using the X-Frame of a large excavator with no modification or alteration of the X-Frame, and does so in a manner that is secure, safe, and easy to install and remove, and maintain the integrity and primary structure of the excavator.

It is thus an object of the invention to provide for all of the foregoing. Other features and objects will be apparent from the disclosure herein.

DESCRIPTION OF THE PREFERRED EMBODIMENTS

Figure 1A:
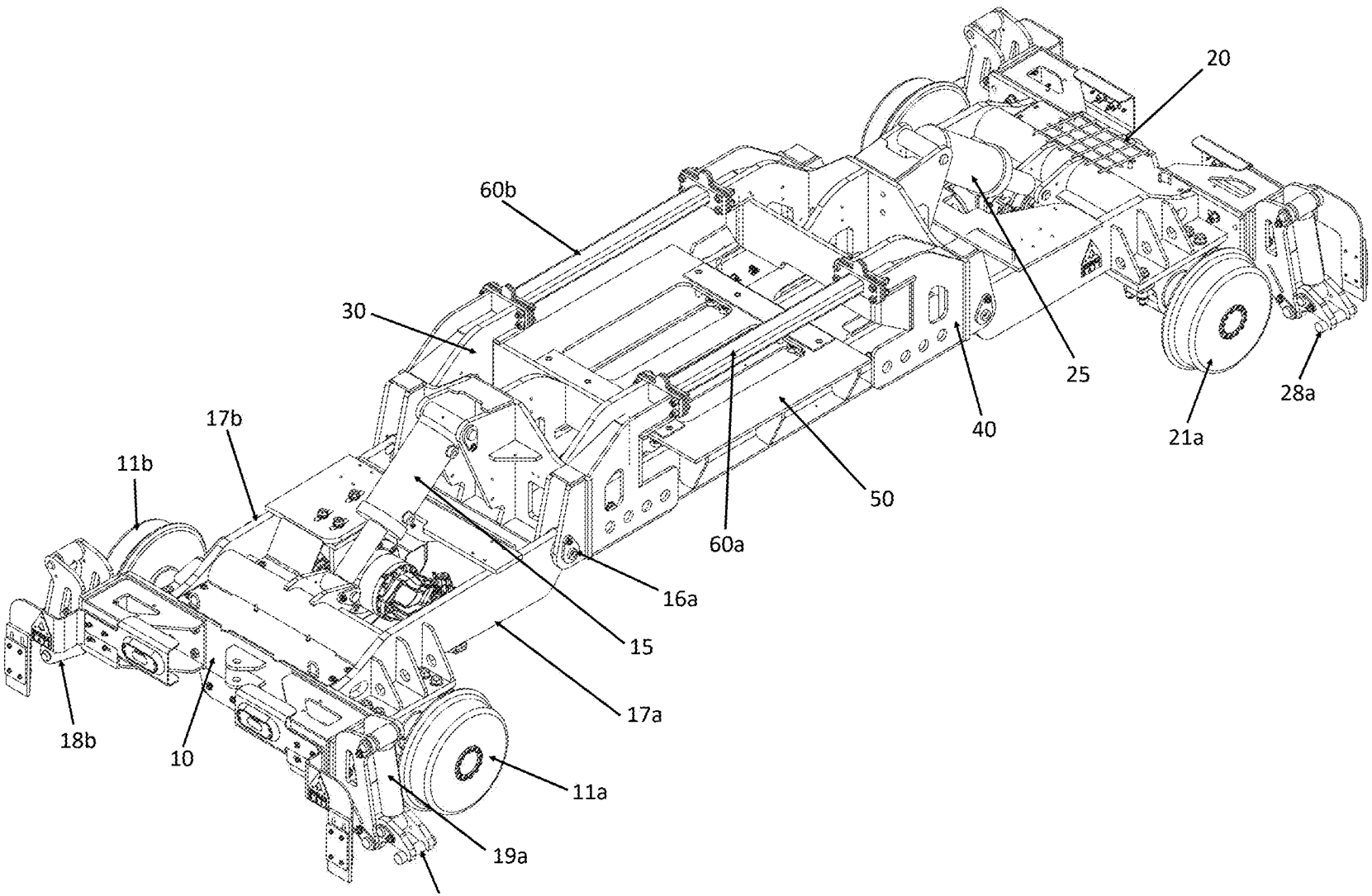
FIG. 1*a* is a perspective view of one mode of the Invention.

The invention and its preferred embodiments are shown in FIG. 1*a*.

Figure 1B:
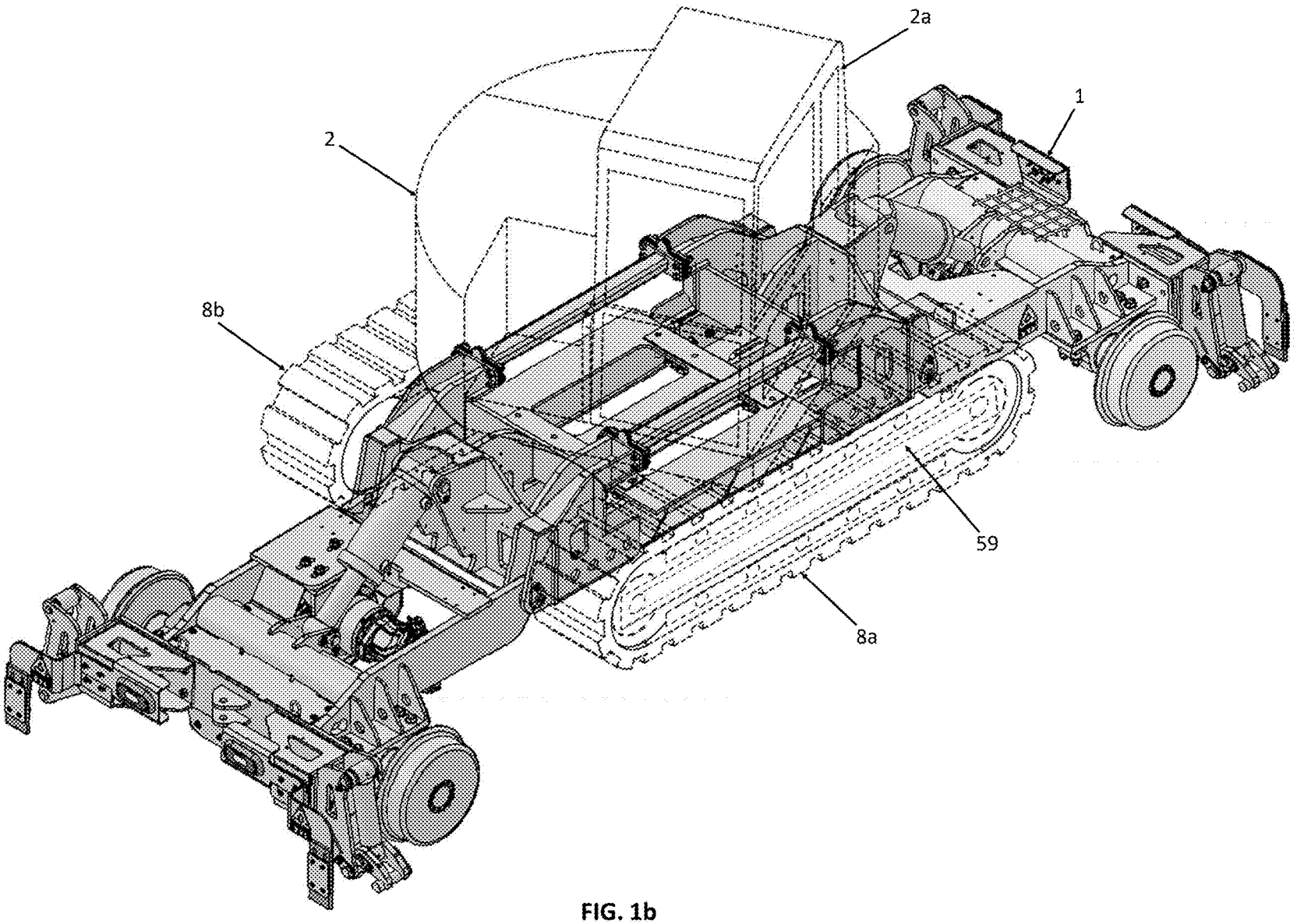
FIG. 1*b* is a perspective that that shows the invention shaded, for illustrative purposes, with the excavator shown in relation thereto in dashed lines.

FIG. 1*b* shows, for illustrative purposes, the invention with a crawler mobilized machine, in this case an excavator. The excavator 2, also referred to as OEM or Original Equipment Manufacturer, is shown in dashed lines, with its cab assembly 2*a*, undercarriage 59 with crawler tracks 8*a* and 8*b*. The invention 1 is shown as shaded. The undercarriage 59 includes the tracks and related structure and parts that retain the tracks to the excavator in a moveable fashion when operated on the ground in normal mode (off-rail).

Figure 2A:
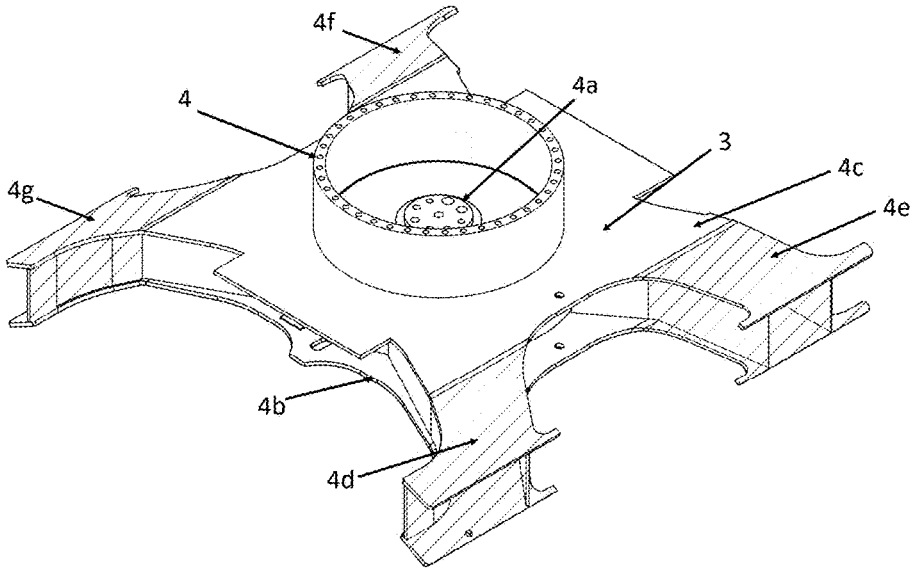
FIG. 2*a* is a perspective view of the excavator X-Frame.
Figure 3A:
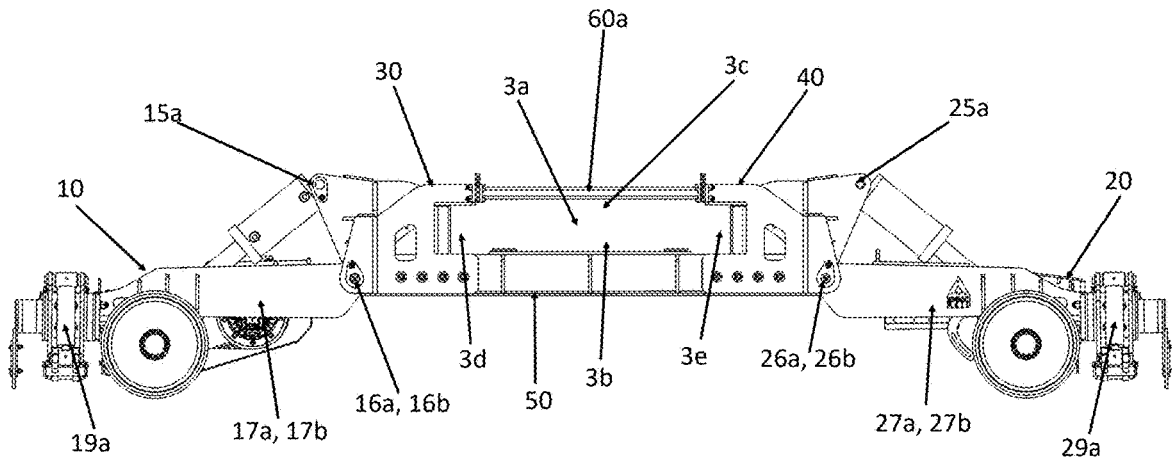
FIG. 3*a* is a side view of one mode of the invention without the X-Frame.

The invention, with reference here to FIG. 1*a* and FIG. 3*a*, has a front support structure 30 attached to front high-rail apparatus 10, and rear support structure 40 attached to rear high-rail apparatus 20, a lower support structure 50 in between said front and rear support structures, connecting the front and rear support structures in the lower area 3*b* shown in FIG. 3*a*. Upper connector struts 60*a* and 60*b* connect the front and rear support structures in the upper area 3*c* shown in FIG. 3*a*. The front, rear, lower structures and upper struts together form an open space 3*a* in FIG. 3*a*. It is this open space 3*a* in which the OEM's (original equipment manufacturer) X-Frame 3 shown in FIG. 2*a* will be. Once all parts are tightened as discussed herein, they will pressure envelop the X-Frame horizontally or vertically (with vertical being the up direction up and down with respect to the ground and cab), in essence clamping down on the X-Frame in a substantially noninvasive manner. "Substantially" noninvasive" here is used to mean excluding drilling into or penetrating the X-Frame metal to insert any screw, bolt or other protrusion. Using this invention to primarily secure the X-Frame secures the excavator to the invention without the need for drilling holes, penetrating or otherwise damaging the OEM X-Frame or other parts of the excavator.

Except where clear otherwise, in general throughout herein, paired part references using 'a' and 'b' references refer to the side of the unit each part of the pair is on. Typically, paired part references with 'a' refer to one side of the unit, and the paired part reference 'b' refers to the corresponding connection/part on the opposite side of the unit as context suggests.

The OEM X-Frame 3 is shown in more detail in FIG. 2*a*. A lower part is shown as a set of two rigid planar opposite members 4*b* and 4*c* that create an essentially planar structure otherwise held together with vertical members. These are considered essentially one planar structure for purposes of this description and shown together without extensions as X-Frame lower part 4*i* in FIG. 2*d*, discussed further herein. Typical X-Frames have an X-Frame slewing ring mount 4 and rotary hydraulic manifold 4*a*. The X-Frame slewing mount 4 is bolted or otherwise attached to rotational means on the lower part of the cab assembly 2*a* to allow cab rotation, such that when the cab assembly 2*a* (in FIG. 3*b*) is attached to the said mount 4, the cab rotates about the X-Frame, and thus allowing the cab to rotate about the invention that is connected to the X-Frame 3.

The rotary hydraulic manifold 4*a* allows for connection of hydraulic lines from the excavator to the mobilization means, through the X-Frame, to work in cooperation with the rotating cab assembly to allow the rotation while maintaining the hydraulic flow during rotation of the cab assembly 2*a*, discussed further herein.

Figure 2B:
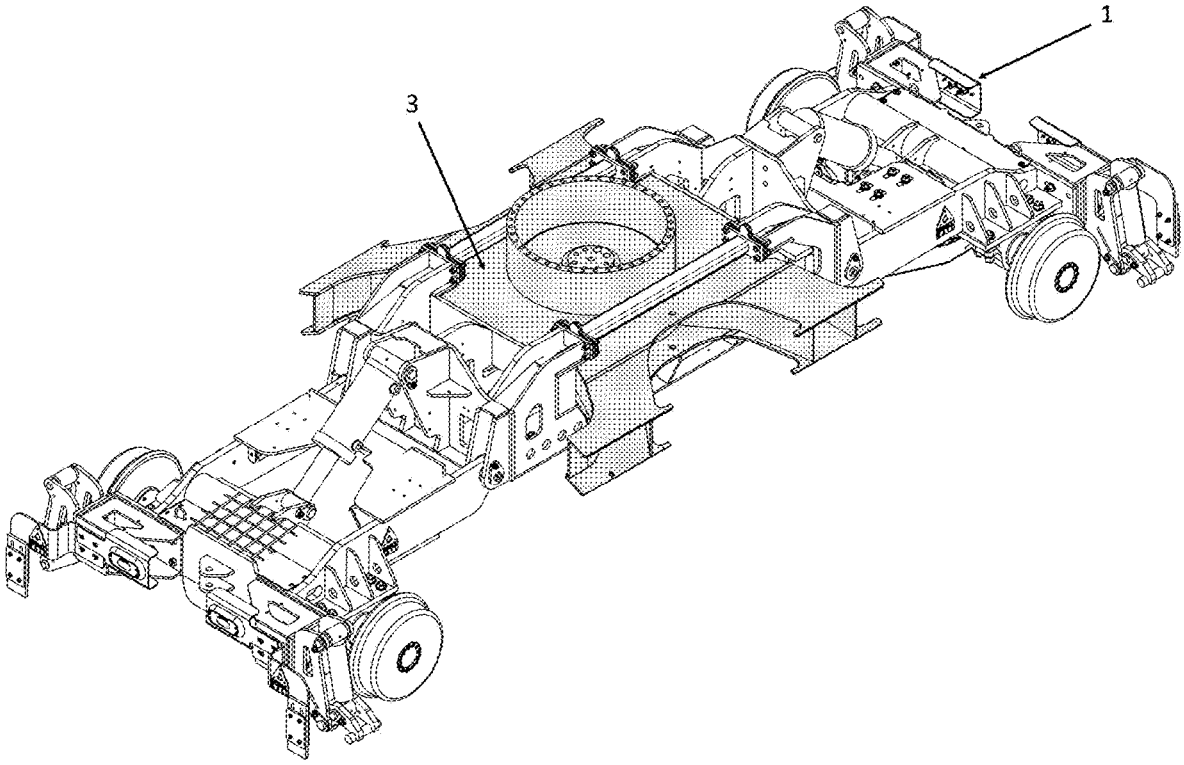
FIG. 2*b* is a perspective view of the invention that shows the X-Frame, shown shaded for illustrative purposes, in relation to the invention.
Figure 2C:
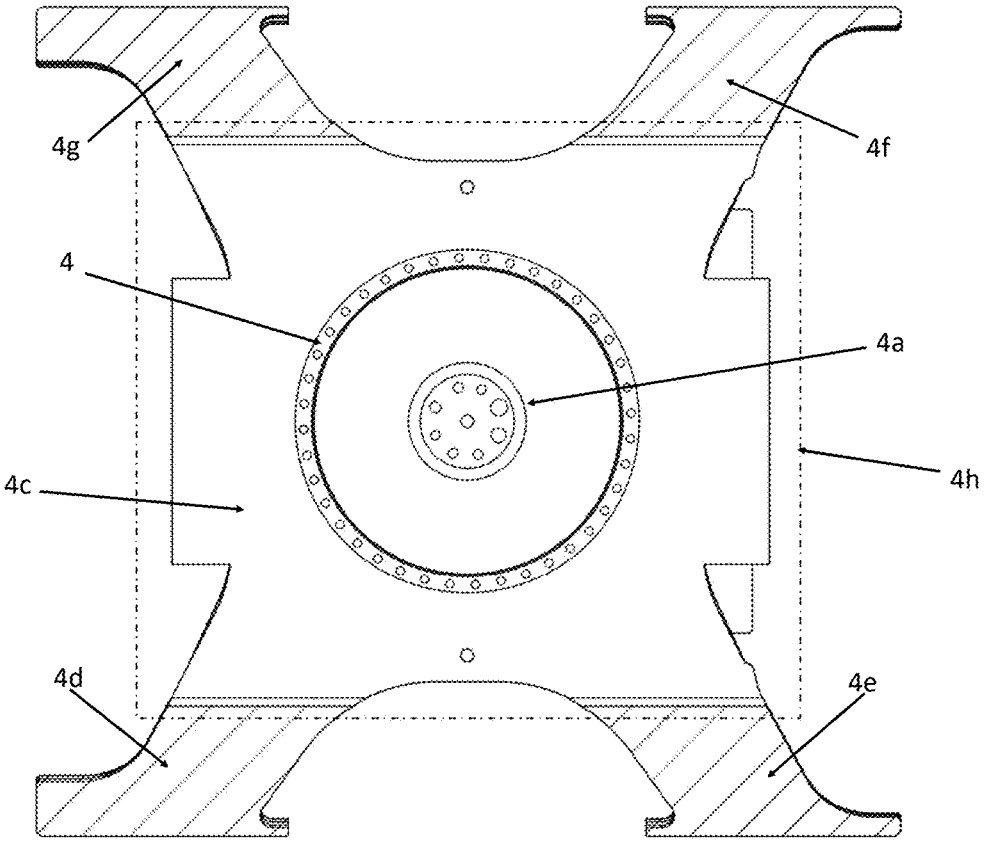
FIG. 2*c* is a top view of the X-Frame showing the X-Frame extensions as cross-hatched.
Figure 2D:
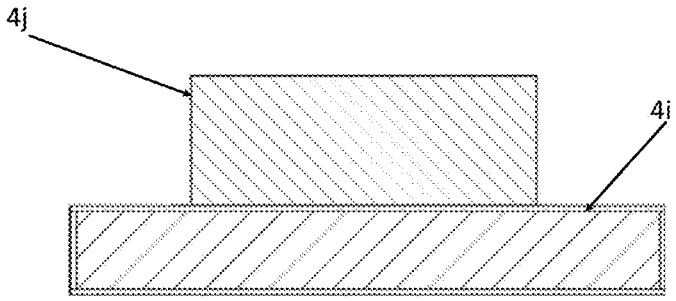
FIG. 2*d* is a side view of the X-Frame shown in FIG. 2*c*, without the X-Frame extensions.
Figure 3B:
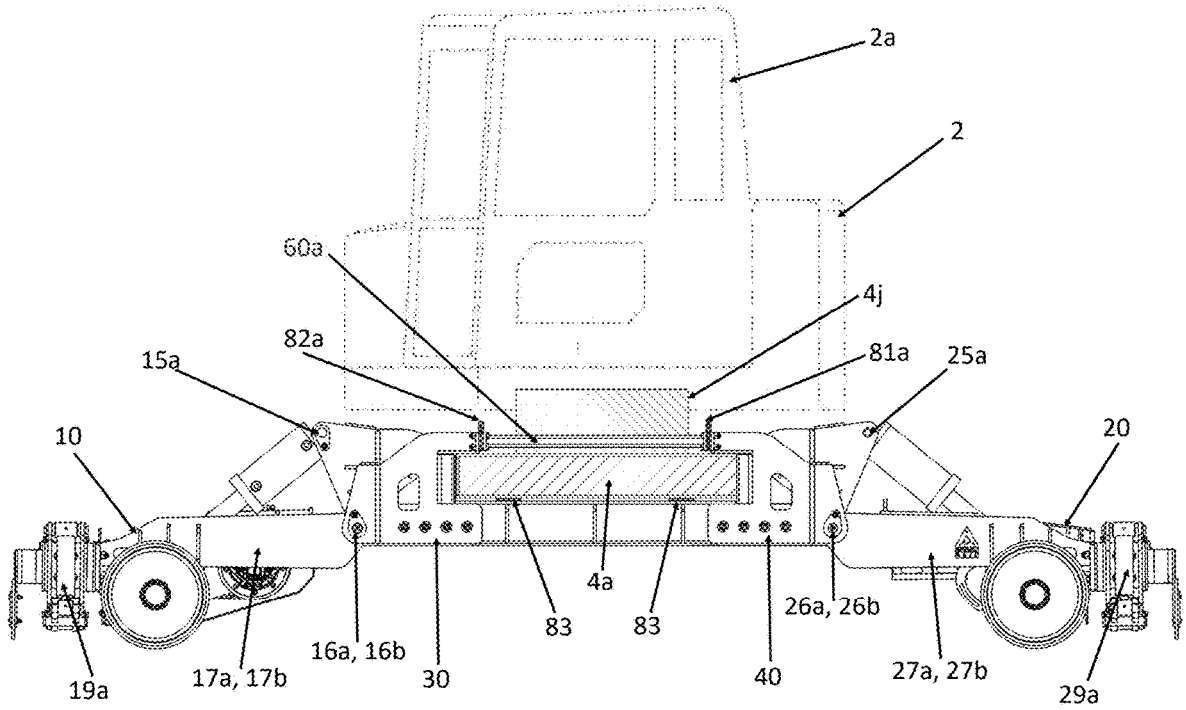
FIG. 3*b*. is a side view of the invention on the original excavator showing the excavator cab in dashed lines and the excavator X-Frame from FIG. 2*d* as shaded.

The typical X-Frame as shown in FIG. 2*a* is generally in the form of an X as shown, however the X-Frame extensions 4*d*, 4*e*, 4*f*, 4*g*, shown shaded, are for the crawler undercarriage to connect to. This can be more easily seen in FIG. 2*b* where the full X-Frame is shown in place as shaded, and again in the top view of the X-Frame shown in FIG. 2*c*. However, for ease of illustration in other drawings, these X-Frame extensions are not shown, as in FIG. 2*d* and other Figures, as will be discussed, so as to better illustrate the key parts of the X-Frame in the preferred mode that allow for retention of the X-Frame within the invention X-Frame space 3*a*. Thus, the dashed box 4*h* in FIG. 2*c* is there to show the respective X-Frame without the X-Frame extensions, and thus the side view of the X-Frame without X-Frame extensions is shown in FIG. 2*d*. This view in FIG. 2*d* is typically that shown in other figures hereafter as will be discussed in each such figure.

Thus, the X-Frame, from the side view, is composed of an X-Frame lower portion 4*i* and an X-Frame upper portion 4*j*.

As indicated, the primary means for securely connecting the invention to the OEM X-Frame is by securely enveloping the X-Frame in space 3*a* in FIG. 3*a*. This space has a lower X-Frame space 3*b* essentially adjacent to the lower portion 4*b* of the X-Frame, and an upper X-Frame space 3*c* essentially adjacent to the upper portion 4*c* of the X-Frame, and a front X-Frame space 3*d* and rear X-Frame space 3*e*. These directions of upper, lower, front, and rear, are the relative directions used throughout this description.

Figure 4:
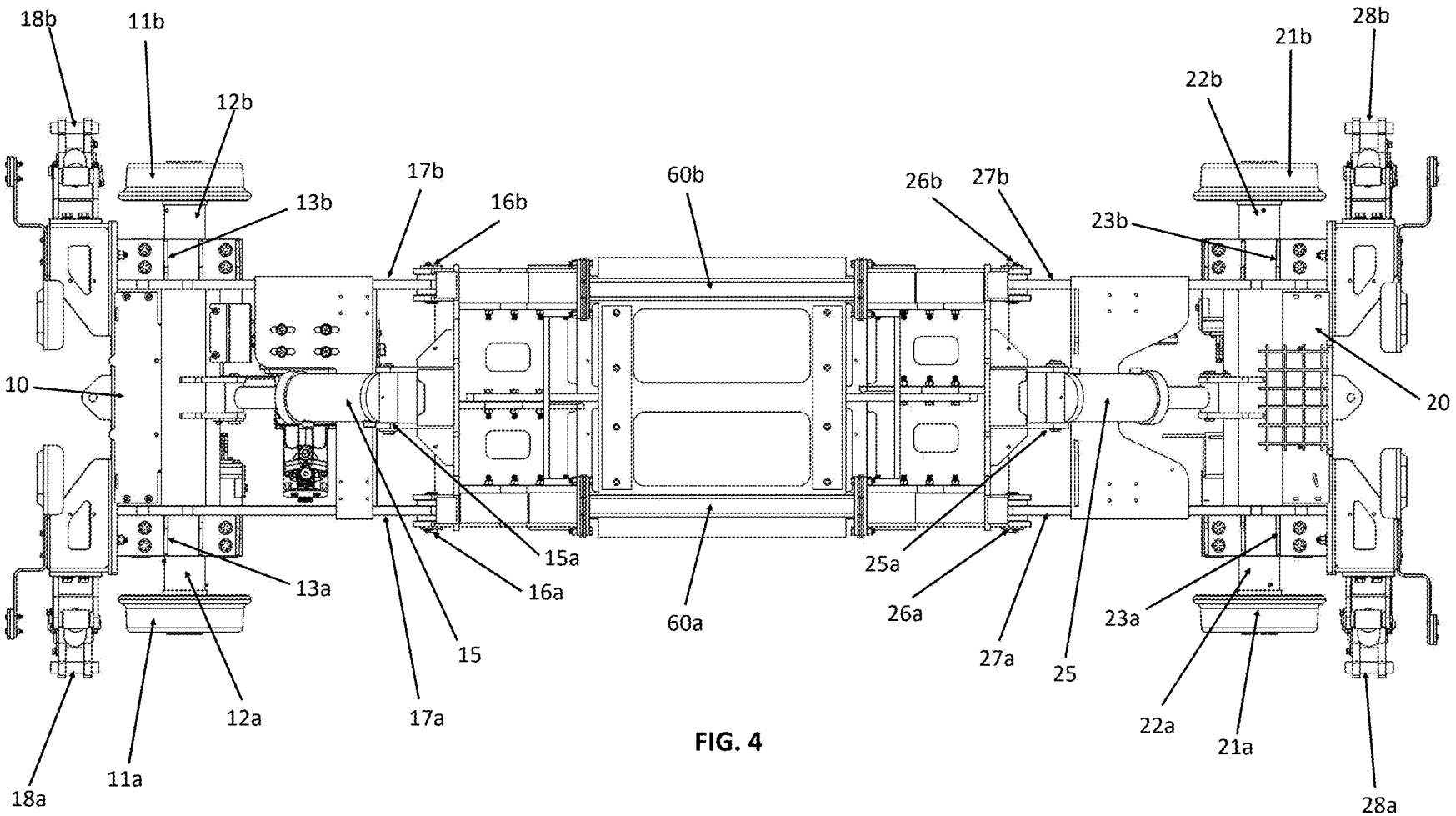
FIG. 4 is a top view of the mode of the invention shown in FIG. 3*a*.

Referring again to FIGS. 1*a* and 3*a*, and FIG. 4, and FIG. 9*a*, 9*b*, that describe certain parts of the invention in the preferred mode, front high-rail apparatus 10 has rail wheels 11*a*, 11*b*, axle 12*a*, 12*b* (which may be two axles or connected as one axle unit), brakes 13*a*, 13*b* (FIG. 4), hydraulic drive motor 73 (FIG. 9*a*, 9*b*) connected to the axle to drive the wheels, discussed further herein, and other components that will provide drive and braking power to the wheels. These are operated through hydraulic lines connected to the rotary hydraulic manifold 4*a* via connections at 75*b*, further discussed with reference to FIG. 9*a*. It also includes hydraulic cylinder 15 rotatably connected to the front support structure at point 15*a* in FIGS. 3*a*, 3*b*, and 4 preferably via removable connections such as bolts or pins. Front rail lower rigid members 17*a* and 17*b* are rotatably connected to the front support structure at 16*a*, 16*b* respectively. The hydraulic cylinder 15 will raise and lower the front high-rail apparatus to bring the wheels 11*a* and 11*b* off the rails when desired, inasmuch as the front high-rail apparatus rotates about points 16*a*, 16*b*, and 15*a* during such hydraulic extension and withdrawal. Front clamps 18*a* and 18*b* have hydraulic cylinders connected to them. Clamp hydraulic cylinder 19*a* is shown connected to operate clamp 18*a*. Clamp 18*b* also has its clamp hydraulic cylinder on the other side, connected in the same fashion as 19*a*. These clamp cylinders activate the clamps to grab the rails to provide stability for the machine when stationary.

Figure 9A:
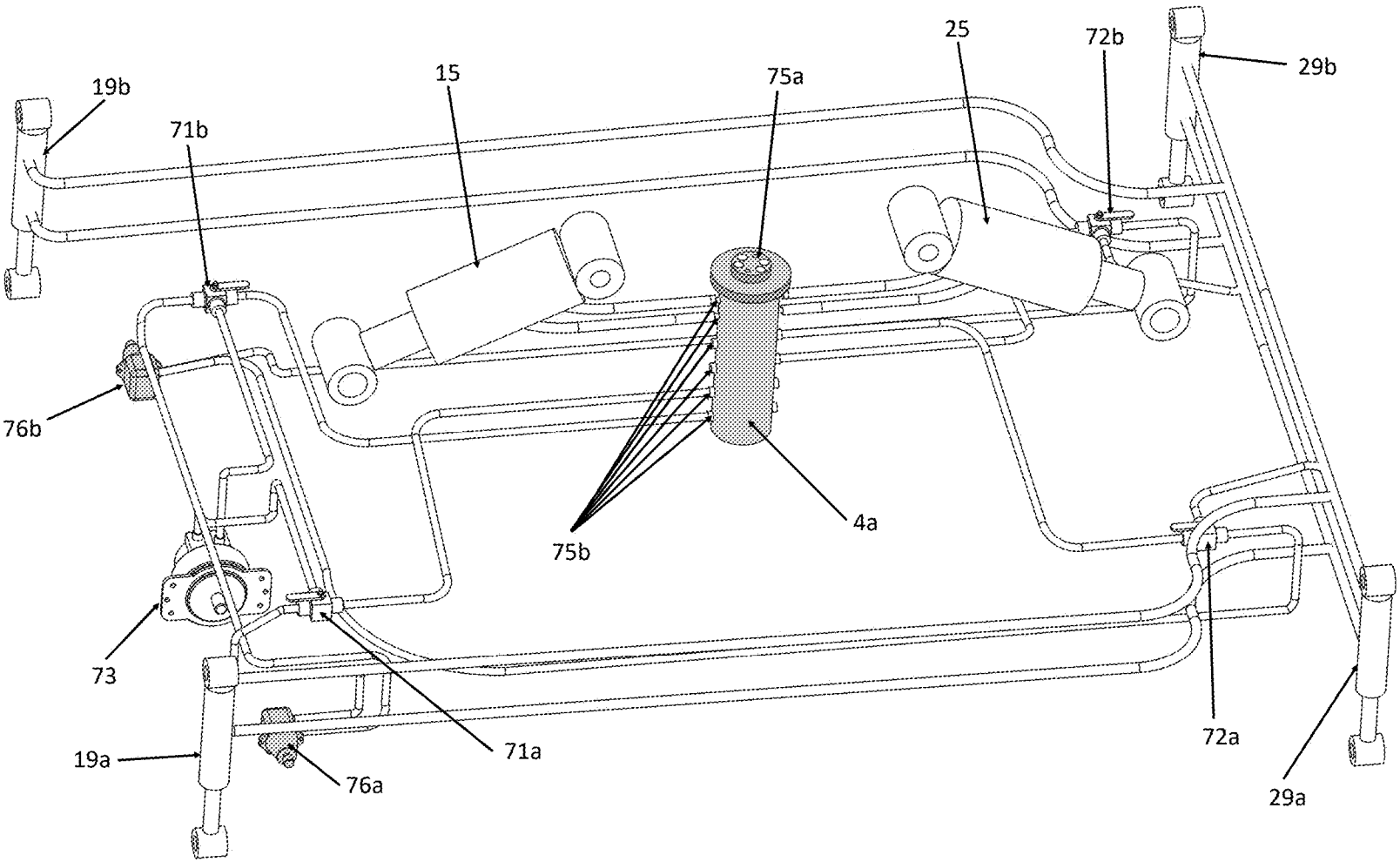
FIG. 9*a* is a diagram of the invention hydraulic circuit with diverting valves shown, as connected to the excavator (OEM) rotary hydraulic manifold (OEM manifold shaded).

Rear high-rail apparatus 20 is similar to the front high-rail apparatus 10. It has rail wheels 21*a* and 21*b*, axles 22*a* and 22*b* (which may be two axles or connected as one axle unit), brakes 23*a* and 23*b*, and other components that will add drive and braking power to the wheels. These are operated through hydraulic lines connected to the rotary hydraulic manifold 4*a* via connections at 75*b* as shown in FIG. 9*a*. In an alternative mode, the rear wheels are connected to an alternator to charge the battery that might operate lights or other incidental electrical features of the invention.

Rear high-rail apparatus also includes hydraulic cylinder 25 rotatably connected to the rear support structure 40 at point 25*a*, preferably via removable connections such as bolts or pins. Rear rail lower rigid members 27*a* and 27*b* are rotatably connected to the rear support structure at 26*a*, 26*b* respectively. The hydraulic cylinder 25 will raise and lower the rear high-rail apparatus to bring the wheels 21*a* and 21*b* off the rails when desired, inasmuch as the rear high-rail apparatus rotates about points 25*a*, 26*a*, and 26*b* during such hydraulic extension and withdrawal. Rear clamps 28*a* and 28*b* have hydraulic cylinders connected to them. Clamp hydraulic cylinder 29*a* is shown connected to operate clamp 28*a*. Clamp 28*b* also has its hydraulic clamp cylinder on the other side connected in the same fashion as 29*a*. These clamp cylinders activate the clamps to grab the rails to provide stability for the machine when stationary.

It should be understood that while a single dual hydraulic cylinder 15 and 25 for each of the front and rear high-rail apparatus is shown, more than one may be used at each or either end as needed with corresponding increase in the relative connection points.

Figure 5:
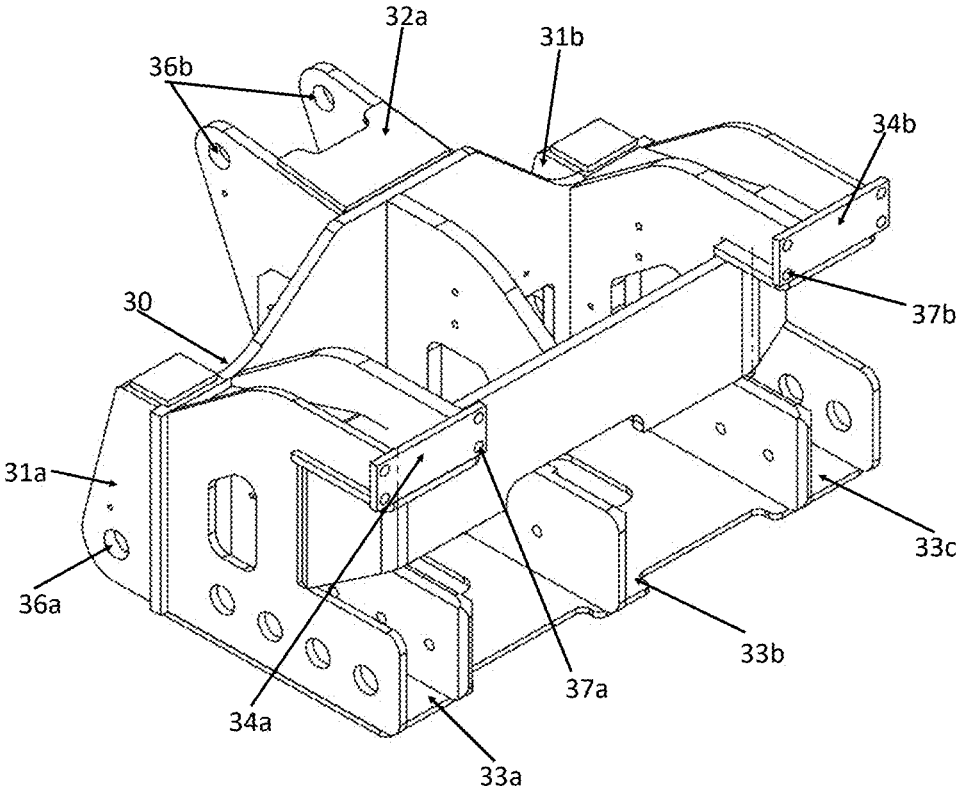
FIG. 5 is a perspective view of the front support structure of the invention in FIG. 3*a*.
Figure 7:
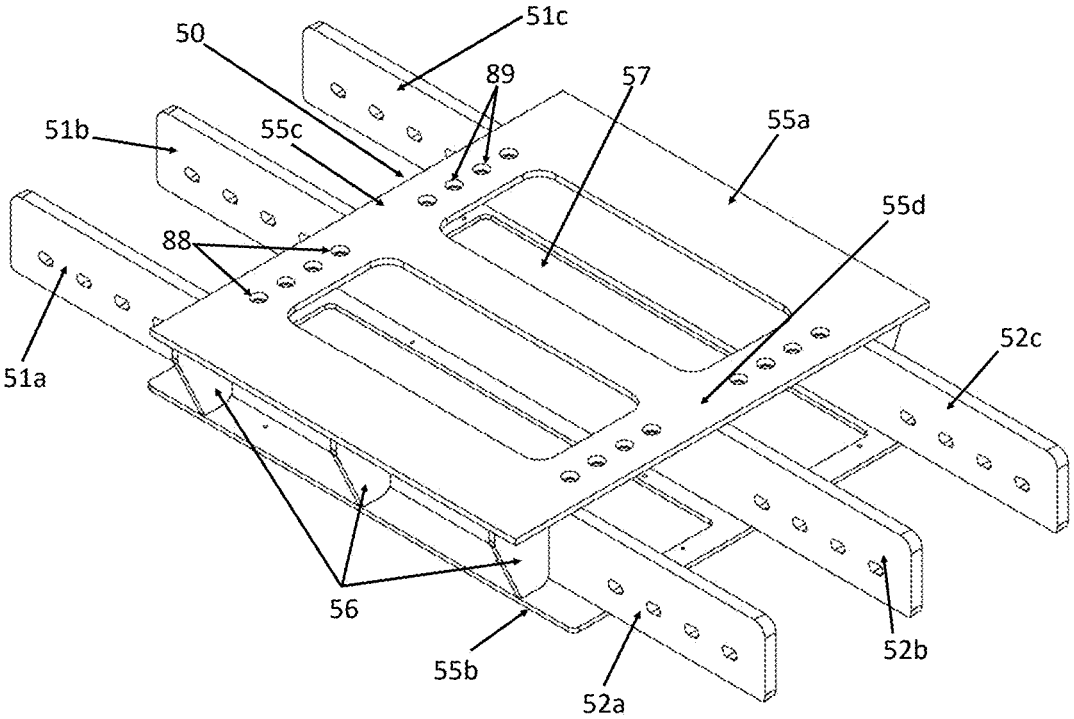
FIG. 7 is a perspective view of the lower support structure of the invention shown in FIG. 3*a*.

Front support structure 30 shown in FIG. 5 is rigid, preferably of fabricated steel construction. It has brackets 31*a*, 31*b*, and 32*a* to which the front high-rail apparatus is rotatably connected in at least three places: first at 16*a* (FIG. 4) via at least one hole 36*a* on bracket 31*a*; second at 16*b* (FIG. 4) via at least one corresponding hole on the opposing side on bracket 31*b*; and third, at 15*a* via holes 36*b* connecting bracket 32*a* to Hydraulic Cylinder 15. The front support structure also includes front side lower receptacle 33*a*, front middle lower receptacle 33*b* and front side lower receptacle 33*c* that face away from the front high-rail apparatus generally frontally toward the X-Frame space 3*a* side of the structure so as to receive the corresponding extensions (lower front side extension, lower front middle extension and lower front side extensions, 51*a*, 51*b* and 51*c* respectively) of the lower support structure 50 (FIG. 7). Said extensions are connected via bolts in corresponding holes in the receptacles and extensions. Other removable connection methods are envisioned, and as seen in the alternative modes, it is envisioned these connections to the extensions could be welded or otherwise permanently connected depending on the embodiment used. Front upper connector strut brackets 34*a* and 34*b* removably connect to front upper connector strut brackets 62*a* and 62*b* via at least one or more holes 37*a*, 37*b*, to holes 65*a*, 65*b*, respectively, preferably with removeable bolts (FIG. 8).

Figure 6:
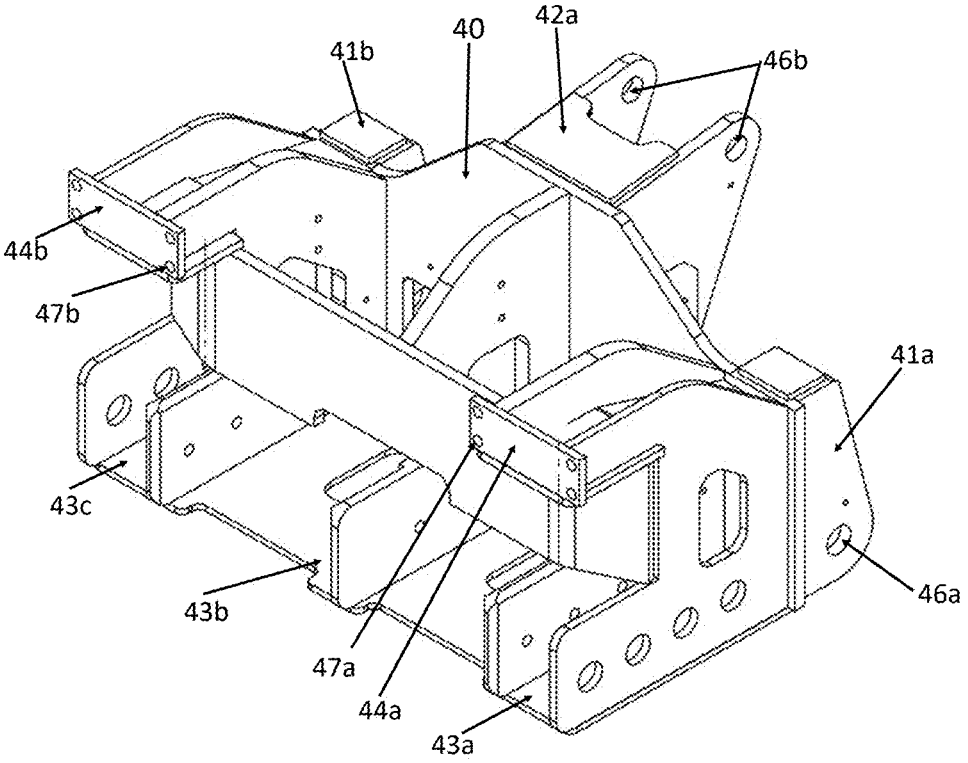
FIG. 6 is a perspective view of the rear support structure of the invention shown in FIG. 3*a*.

Rear support structure 40 shown in FIG. 6, is rigid, preferably of fabricated steel construction, that features brackets 41*a*, 41*b*, and 42*a* to which the rear high-rail apparatus is rotatably connected in at least three places: first at 26*a* (FIG. 4) via at least one hole 46*a* on bracket 41*a*; second at 26*b* (FIG. 4) via at least one corresponding hole on the opposing side on bracket 41*b*; and third, at 25*a* via holes 46*b* connecting bracket 42*a* to Hydraulic Cylinder 25. The rear support structure also includes rear side lower receptacle 43*a*, rear middle lower receptacle 43*b* and rear side lower receptacle 43*c* that face away from the rear high-rail apparatus and generally toward the X-Frame Space (3*a*) side of the structure so as to receive the corresponding extensions (lower rear side extension, lower rear middle extension and lower rear side extension, 52*a*, 52*b* and 53*c* respectively) of the lower support structure 50 (FIG. 7). Said extensions are connected via bolts in corresponding holes in the receptacles and extensions. Other removable connection methods are envisioned, and as seen in the alternative modes, it is envisioned these connections to the extensions could be welded or otherwise permanently connected depending on the embodiment used. Rear upper connector strut brackets 44*a* and 44*b* removably connect to rear upper connector struts 63*a* and 63*b* via at least one or more holes 47*a*, 47*b*, and 66*a*, 66*b*, respectively, preferably with removable bolts (FIG. 8).

Lower support structure 50 in FIG. 7 is a rigid member, preferably planar in shape, having a lower support top surface 55*a* that is essentially planar and facing the bottom 4*c* of the X-Frame (FIG. 2*a*) and has an opposing lower support bottom surface 55*b* with a lower support front end 55*c* (front end here being on the side of the front support structure) and a lower support rear end 55*d* (rear end here being on the side of the rear support structure). The lower support top surface and lower support bottom surface are made to act as one solid piece (and may as an alternative be in fact one solid structure provided it has extensions as set forth hereafter) via rigid connecting pieces 56 added throughout that are welded or otherwise solidly secured to the two said surfaces 55*a* and 55*b* to hold them together as one piece. The two said surfaces may have openings (such as at 57) to reduce the weight so long as the structural strength and integrity is maintained. The entire lower support structure is rigid and is intended to support the weight of the entire hydraulic excavator 2 with the front and rear support structures 30 and 40 when it is positioned and touching the X-Frame, which rests upon the entire composition of structures 30, 40, 50, 60*a*, 60*b*. Extensions 51*a*, 51*b*, and 51*c* on the front end, and extensions 52*a*, 52*b*, and 52*c* on the rear end are machined to insert into the receptacles 33*a*, 33*b*, and 33*c* referred to above on the front support structure and 43*a*, 43*b* and 43*c* on the rear support structure, respectively. Jacking bolt holes 89 for one end are the two holes in the middle of four holes, as shown and are threaded to receive jacking bolts 87 for tightening, and two shim plate guide holes 88 on the end of each of the four holes receive the shim plate guides 86, discussed in more detail with reference to FIGS. 10*a* and 10*b*.

Figure 8:
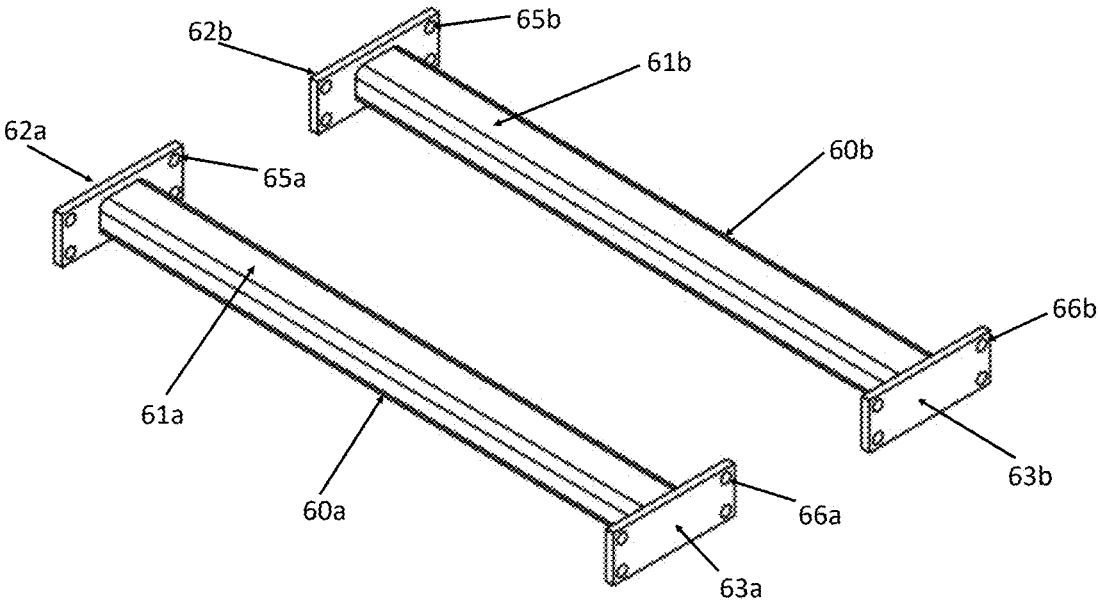
FIG. 8 is a perspective view of the upper connector struts of the invention shown in FIG. 3*a*.

The upper connector struts 60*a* and 60*b* in FIG. 8 are rigid members, and in the preferred mode are elongated. Each upper connector strut 60*a* and 60*b* is designed to fit above the X-Frame and on either side of the rotational means 4 (FIG. 2*a*). Each upper connector strut is comprised of the upper connector strut beam, 61*a* and 61*b*, the front upper connector strut bracket, 62*a* and 62*b*, and the rear upper connector strut bracket, 63*a* and 63*b*. The front upper connector strut brackets have the desired number of machine bolt holes 65*a*, 65*b* that connect with bolts to holes 37*a*, 37*b* of the front upper connector brackets 34*a*, 34*b*. The rear upper connector strut brackets have the desired number of machine bolt holes 66*a* and 66*b* that connect with bolts to holes 47*a*, 47*b* of the rear upper connector brackets 44*a*, 44*b*. Struts 61*a* and 61*b* could be one piece so long as there exists space allowance for the rotational means 4 in the X-Frame 3 and that the said one piece has means for installing the said one piece about the rotary hydraulic manifold means 4 without altering the excavator 2.

Figure 10A:
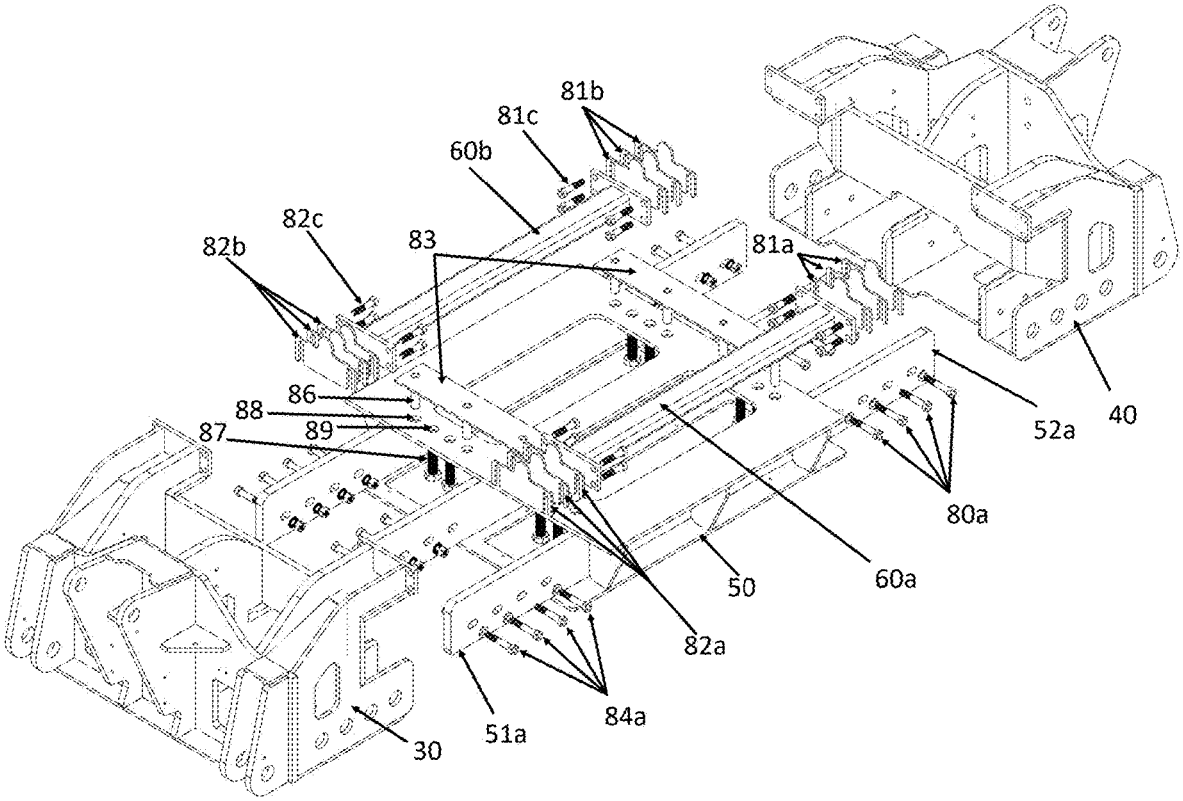
FIG. 10*a* is a perspective view of the invention parts showing the relative position.
Figure 10B:
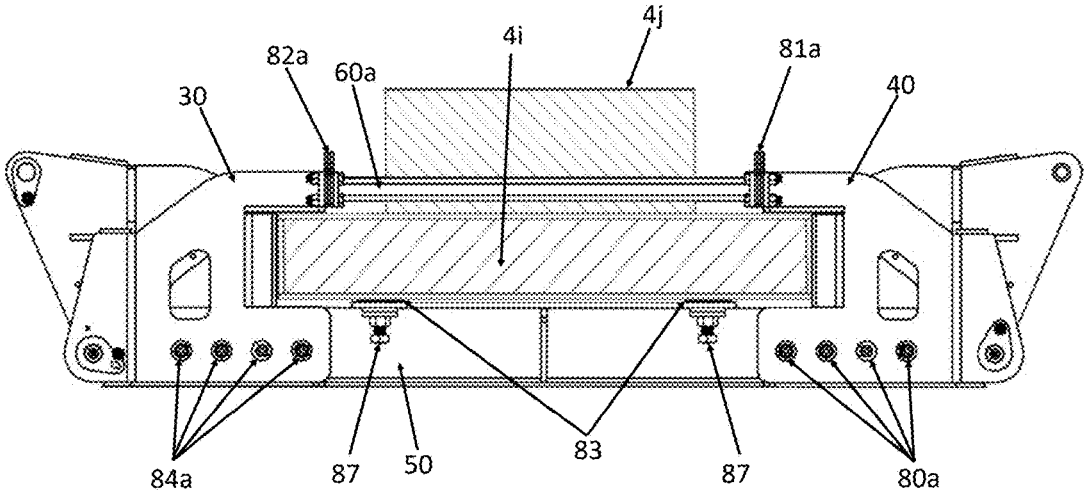
FIG. 10*b* is a side view of the invention that envelops the Excavator (OEM) X-Frame (X-Frame shown as in FIG. 2*d* without X-Frame extensions and shaded).

These subparts (30, 40, 50, 60*a* and 60*b*) that surround the X-Frame and pressure envelop it, as well as the desired shims, are secured together against the X-Frame with one or more tightening bolts as shown in FIGS. 10*a* and 10*b*. Additional shims or spacers may be needed and used to take up any space horizontally and vertically between the X-Frame 3 (more particularly in this case the lower part 4*i*) and the front and rear support structures in the likely event that the X-Frame does not precisely fill the X-Frame space 3*a*, i.e. there exists a 'loose fit'. Horizontal shims are shown as 81*a* and 82*a* on the 'a' side in FIG. 10*a* and can be seen as 81*b* and 82*b* on the 'b' side. Tightening bolts 81*c* and 82*c*, and others similarly situated as shown, extend through the shims and through the receiving holes in rear and front support structures 40 and 30, respectively. Here, for illustration of at least one method, tightening bolts 81*c* and 82*c* are shown extending through holes in brackets 44*b* and 34*b* (in FIGS. 5 and 6) to be secured by nuts, or said holes can be threaded themselves to screw into. Any number of bolts can be used, and additional similar tightening bolts are shown to connect the two ends together. Vertical and horizontal shims can be plates or other space fillers in any rigid form. Horizontal shim 83 in FIG. 10*a* has at least one shim plate guide, one of which is shown for example as shim plate guide 86 lined up to extend through hole 88. At least one jacking bolt for tightening is shown as jacking bolt 87 extending through threaded hole 89, thus tightening the vertical shim 83 against the X-Frame. Other methods for tightening shim plates are envisioned. Here, 'horizontal' and 'vertical' refer not to the standing up or to the lying flat position of the shim, but instead to the direction they are intended to influence, i.e. vertical shims laid flat and placed between two parts are intended to influence the vertical direction.

Hydraulics of the invention are, in the preferred mode, run through the excavator OEM rotary hydraulic manifold 4 as shown in FIG. 9*a*; however also envisioned is a separate dedicated system, either a hydraulic system or electrical, as part of the invention to be operated by the operator in the cab, independent of the OEM hydraulics.

In FIG. 9*a*, OEM rotary hydraulic manifold 4*a* allows the excavator hydraulic pump to move the oil from the pump on the top side of the machine through the top of the rotary hydraulic manifold, utilizing the rotary hydraulic manifold inlet ports 75*a* in the stator, i.e. the stationary part, through to the line ports 75*b* in the rotor, i.e. the rotating part, to then power the hydraulic functions of the machine, yet still allow the cabin assembly 2*a* to rotate about the rotary hydraulic manifold and excavator undercarriage 59. The rotary hydraulic manifold 4*a* is shown along with the hydraulics utilizing the excavator hydraulics. Diverting valves 71*a*, 71*b*, 72*a* and 72*b* are added to the existing OEM hydraulic lines so as to allow manual dual (or more) repurposing of their intended use when needed, i.e. to use them to operate the invention hydraulics instead of the excavator OEM hydraulics. For example, in operation, when stationary, the operator will want to utilize the appropriate control lever in the cab to operate the track travel motor or to lift the excavator blade or bucket. That same control lever in the cab might be repurposed temporarily by manually (or by remote means as desired) switching one or more of the diverting valves so that the same hydraulic line now might operate the drive motor 73 to move the excavator along the rails, or to raise the front and rear high-rail apparatus off of the rails so as to allow original movement utilizing the original crawler tracks 8*a* and 8*b* (FIG. 1*b* via crawler track motors 76*a* and 76*b* (FIG. 9*a*). Rear control cylinders 29*a* and 29*b* engage and disengage the rear rail clamps 28*a* and 28*b*. The front control cylinders 19*a* and 19*b* engage and disengage the front rail clamps 18*a* and 18*b*. The operator will know in advance which of the levers in the cab have dual purposes, depending on which way the respective diverting valves 71*a*, 71*b*, 72*a*, 72*b*, are positioned for any particular function. Other methods are envisioned to utilize diverting valves from non-rotary manifolds, it being the object here to repurpose the OEM hydraulic control levers in the cab as desired.

Figure 9B:
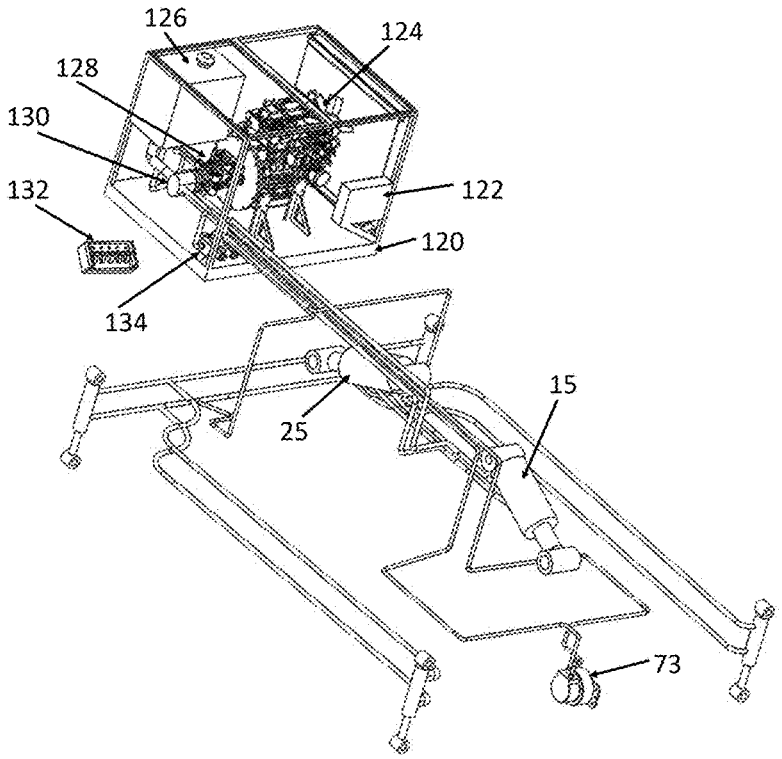
FIG. 9*b*, is a diagram of an alternative independent hydraulic circuit and hydraulic power source utilized by the invention independent of the Excavator hydraulics.

An independent hydraulic system is shown in FIG. 9*b* that does not tap into the OEM hydraulic system, and thus uses no diverting valves. An internal combustion power source 124 runs either a hydraulic system or (through an alternator) an electrical based system, housed with the invention in the preferred mode here as 120. In a hydraulic system, the power source 124 runs the hydrostatic pump 128, providing hydraulic power with hydraulic oil reservoir 126 through the hydraulic lines as shown. Auxiliary pump 130 provides hydraulic power to the lift cylinders 15 and 25 and the rail clamps as in FIG. 9*a* as well as the drive motor 73. Auxiliary valves 134 control the direction of operation of the lift cylinders to lift, and to engage and disengage the rail as desired. Remote Transmitter 132 is used by the operator to control the entire invention through the radio (or hard wired) control and electrical box and receiver 122.

Figure 9C:
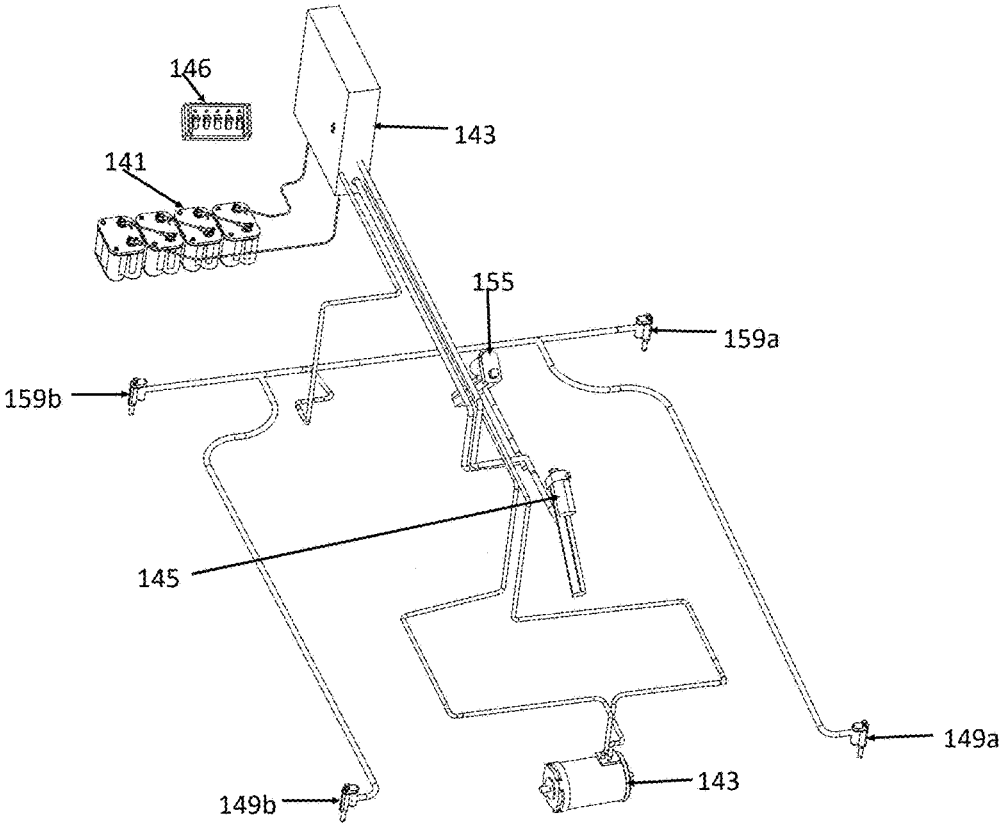
FIG. 9*c* is a diagram of an alternative independent electrical power source circuit used with the invention eliminating use of the excavator hydraulic system.

In FIG. 9*c*, an electrical based system is shown that powers the invention independent of the OEM hydraulics as an alternative mode that also eliminates any need for connecting to any part of the OEM hydraulics. Hydraulic pumps 15 and 25 are replaced with electric linear actuators 145 and 155 to raise and lower the rail apparatus. Electric linear actuators 149*a*, 149*b*, and 159*a*, 159*b*, act to engage and disengage the rail clamps. All actuators are powered electrically by a battery bank 141 and controlled via remote control (radio or hardwired) by controller/remote transmitter 146 through control/receiver box 143. The batteries may be recharged by an on-board internal combustion source as shown in FIG. 9*b* or may be recharged by a portable generator carried along, or by connecting to any available electrical power source as available, or standby battery packs can be used.

Thus, what is shown is a solid structure that securely retains the X-Frame without the need to puncture or breach the X-Frame. This nonbreaching, non-invasive means is preferred for securing to the X-Frame so as to provide a secure fit vertically and horizontally.

Figure 11A:
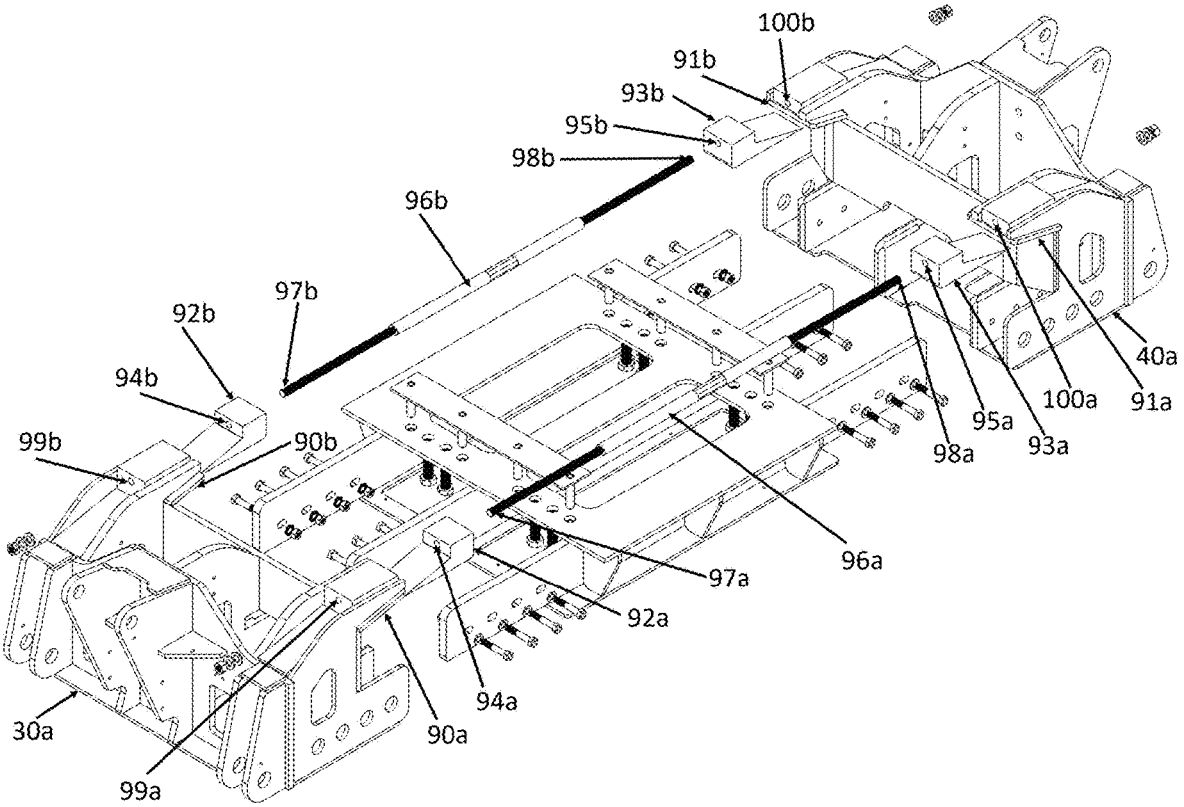
FIG. 11*a* is an exploded perspective view of an alternative mode of the invention using shims with angled features in the front and rear support structures.
Figure 11B:
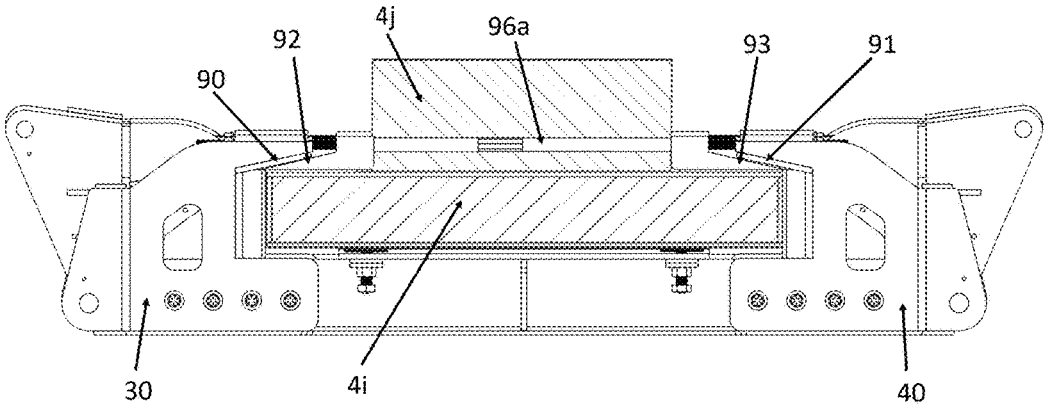
FIG. 11*b* is a side view of the enveloping structure of alternative mode of the invention shown in FIG. 11*a*, shown enveloping the Excavator (OEM) X-Frame using shims and beveled structures (X-Frame shown as in FIG. 2*d* without X-Frame extensions and shaded).
Figure 11C:
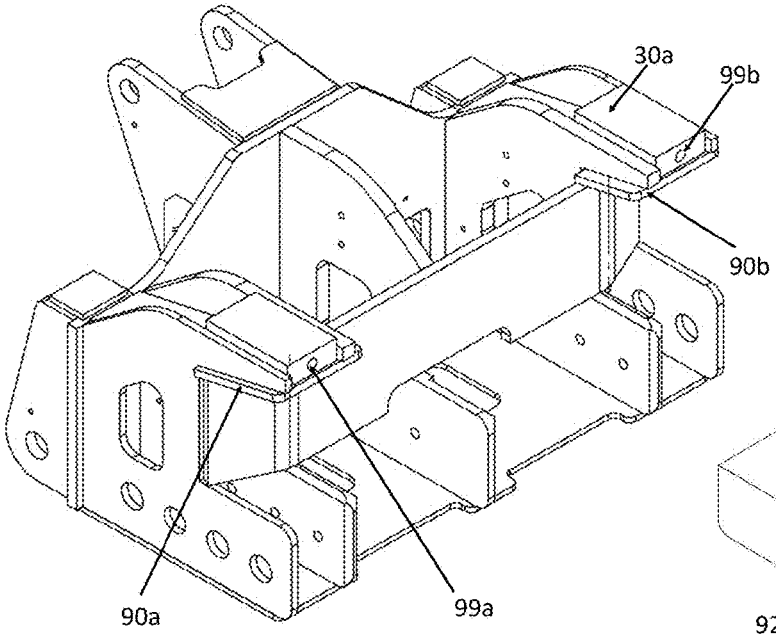
FIG. 11*c* is a perspective view of the front support structure of the alternative mode shown in FIG. 11*a* showing angled portions.
Figure 11F:
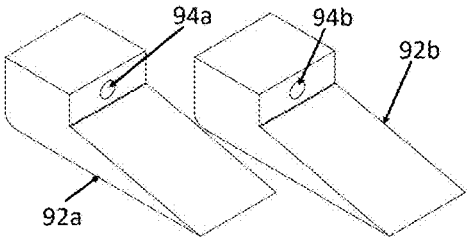
FIG. 11*f* and FIG. 11*g* is a perspective view of the front and rear shim pairs used in the alternative mode shown in FIG. 11*a*.
Figure 11D:
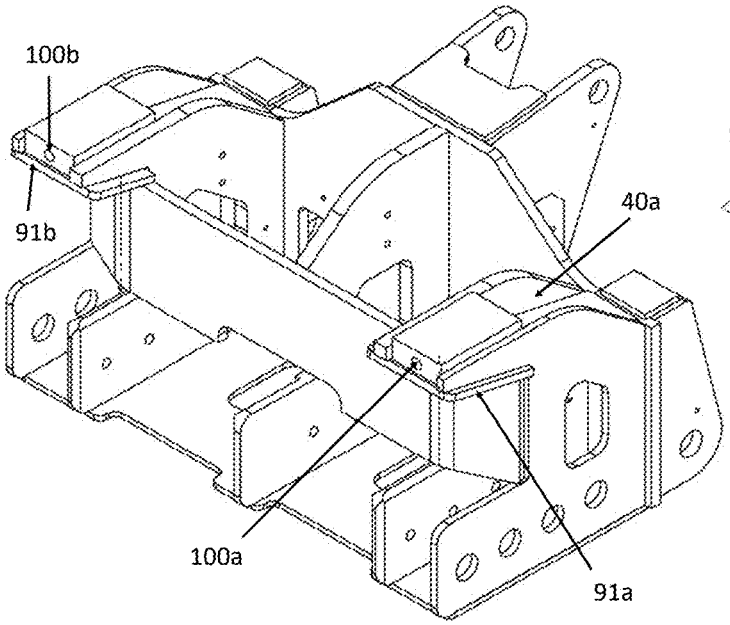
FIG. 11*d* is a perspective view of the rear support structure of the alternative mode shown in FIG. 11*a* showing angled portions.
Figure 11G:
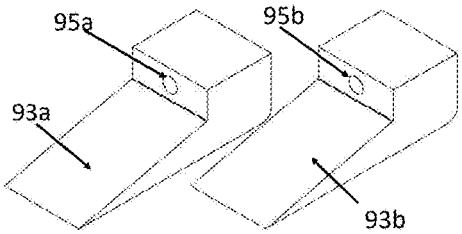
Figure 11E:
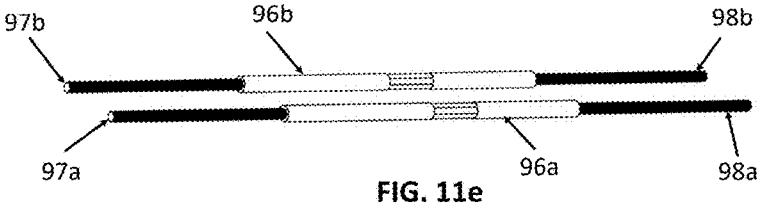
FIG. 11*e* is a perspective view of the tie rods used in the alternative mode shown in FIG. 11*a*.

The issue of a loose fit about the X-Frame is also resolved in an alternative mode of the invention shown in FIGS. 11*a*-11*g*. The front and rear support structures 30*a* and 40*a* are shown with slanted, i.e. beveled portions 90*a*, 90*b* and 91*a*, 91*b*, with respect to the X-Frame, and have corresponding opposite slanting shims 92*a*, 92*b* and 93*a*, 93*b* fitting in between the beveled portions and the X-Frame as shown, each shim having a raised portion with a bolt hole 94*a*, 94*b*, and 95*a*, 95*b* so as to match and correspond to allow the ends 97*a*, 97*b* and 98*a*, 98*b* of tie rods 96*a* and 96*b* respectively to extend to or through the respective shim's bolt holes 94*a*, 94*b* through respective bolt hole 99*a*, 99*b* and 100*a*, 100*b* as shown and be tightened with bolts effectively pulling the front and rear support structures tight into and against the X-Frame in both the horizontal and vertical directions. Thus, the tie rods are connected in this manner to the front and rear support structures, with shims between them and the X-Frame, eliminating a loose fit as the wedging forces work to tighten as the tie rods are tightened. It also allows periodic tightening if normal use should loosen the fit. FIG. 11*b* shows the side view of the foregoing, showing the X-Frame lower portion 4*i* tightly wedged. While the wedges 93 and 94 could be eliminated and still provide horizontal and vertical retention of the X-Frame lower portion 4*i* via the wedge shape of the structure at 90 and 91, the use of the wedges 93 and 94 provides a broader and more stable coverage restriction against the X-Frame. FIG. 11*c*, FIG. 11*d*, FIG. 11*e* and FIG. 11*f* show the parts in more detail.

Figure 12A:
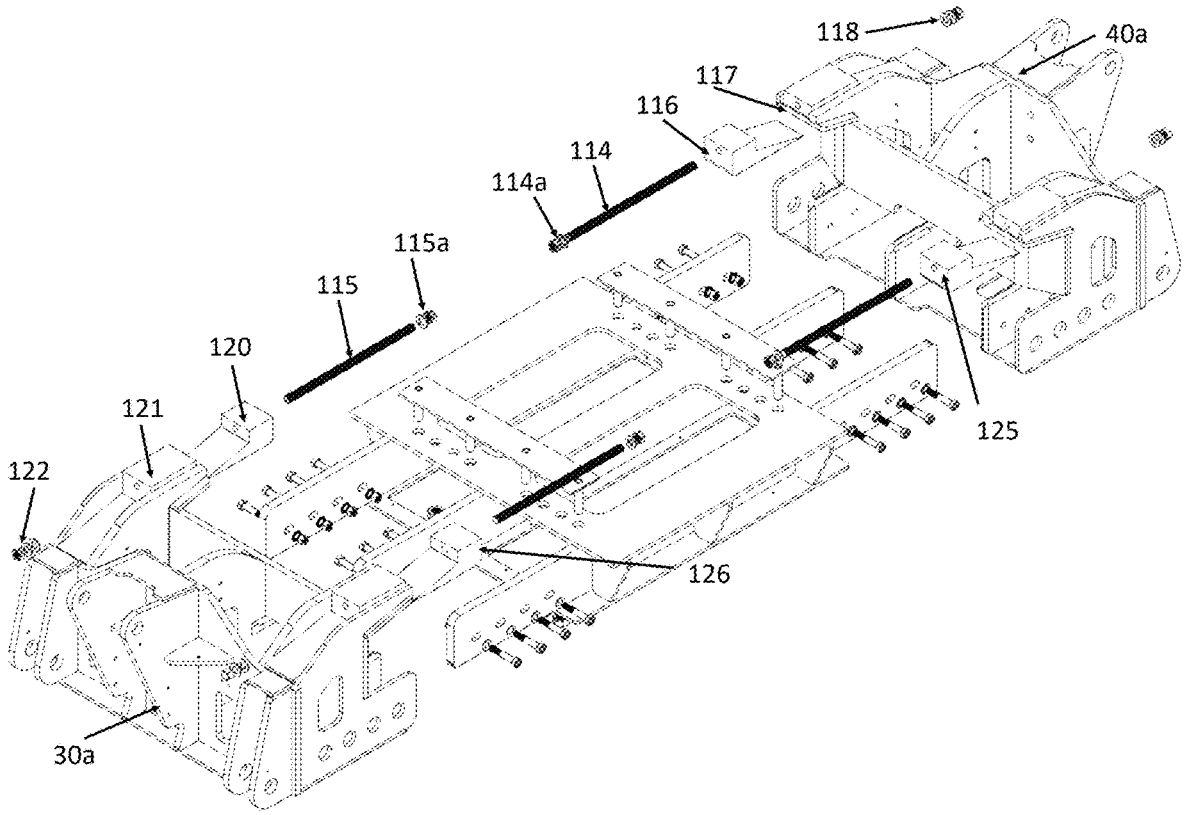
FIG. 12*a* is an exploded perspective view of an alternative mode that uses independent tie rods and beveled wedges.
Figure 12B:
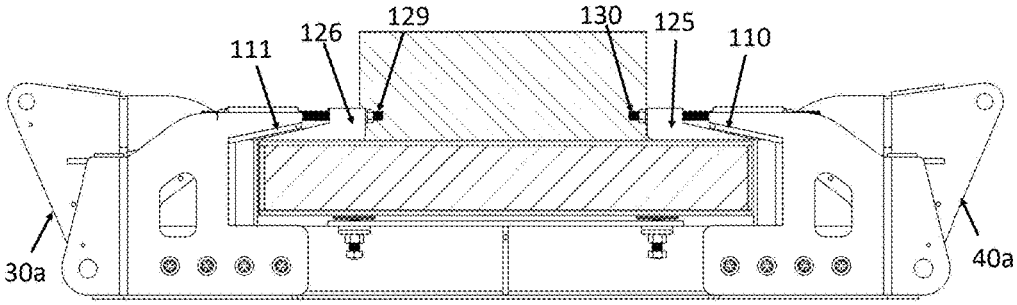
FIG. 12*b* is a side view of the alternative mode of the invention shown in FIG. 12*a* using independent tie rods and beveled wedges with the X-Frame shown shaded without X-Frame extensions.

A further alternative is shown in FIGS. 12*a* and 12*b*, that does not require tie rods or other structure to extend across the top of the X-Frame. Shims and beveled structures are shown similar to that in the mode shown in FIG. 11*a*, however tie rods 114 and 115 are terminated with blocking means 114*a* and 115*a* to provide the stop means when the tie rods are extended through holes in beveled shims 116 and 117 and 120 and 121 respectively. Screw, nut, or other tightening means 118 and 122 are tightened to pull the shims 116 and 120 tight into and against the beveled portions of the front and rear structures 30*a* and 40*a*. This can be seen more easily from the side view in FIG. 13*b*, with shims 125 and 126 operating against the beveled portions 110 and 111. As tightening of the bolts 130 and 129 occurs, driving the opposing beveled portions against each other, tightening occurs, i.e. the respective beveled portions of the shims are driven against those bevel portions at 110 and 111, and as a result, both horizontal and vertical pressure is exerted against the X-Frame, tightening it in all directions. Prior modes discussed use the tie rods to pull the two ends (front support structure and rear support structure) together, towards each other. Thus, this mode allows a tight fit and allows relatively easy periodic tightening as needed.

Figure 13:
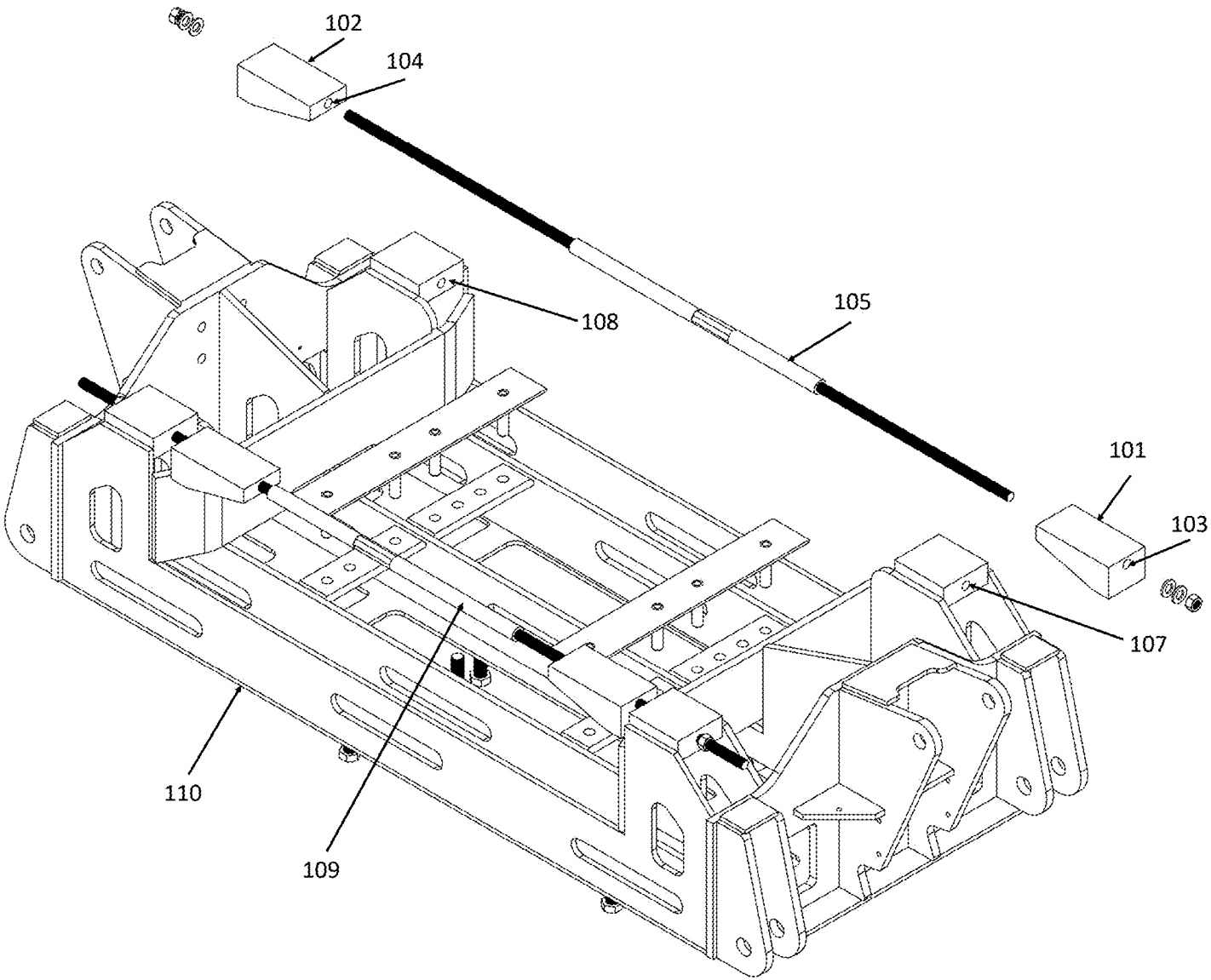
FIG. 13 is an alternative mode of the enveloping portion of the invention showing a one-piece version for the front, rear and lower support structures, and utilizing shims.

In another alternative mode, also addressing a loose fit, a one-piece structure 110 in FIG. 13 shows the front support structure, the rear support structure, and the lower support structure all combined into one solid structure. Shims 101 and 102 have holes 103 and 104 and tie rod 105 extends through them to holes 107 and 108 (along with corresponding structures on the opposite side) to pull the shims tight and wedge against the X-Frame. These shims operate in this mode, as can be seen, slightly differently than those in FIG. 11*a*, however they achieve the same purpose to pull tight against the X-Frame to create one solid structure, and also allow periodic tightening if necessary to maintain the rigid connection of the invention to the X-Frame. Tie rod 109 on the opposing side is shown with all related parts in place for illustration.

The method in which the invention is installed with the OEM excavator is shown in FIGS. 14*a* through 14*f*.

Figure 14A:
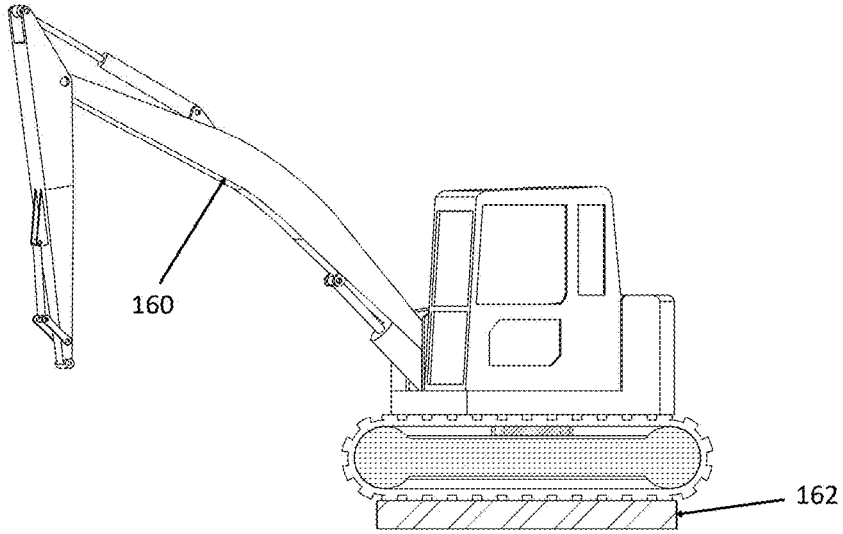
FIG. 14*a* through 14*f* show the steps of conversion in the preferred inventive method.

First, the excavator is moved to flat and level ground using its existing track mobility and driven up on cribbing 162 so as to elevate the excavator at least approximately nine inches from the bottom of the track to the floor, FIG. 14*a*. The boom 160 of the excavator should be off to the side so as to remove it from interfering with the front and/or rear high-rail apparatus, preferably 90 degrees to the side (although FIG. 14*a* is showing the boom less than 90 degrees so as to more clearly show the invention).

Next, one end of the hydraulic lines for the invention are connected to the OEM's rotary hydraulic manifold, keeping the other end of the lines located inside the X-Frame capped.

Figure 14B:
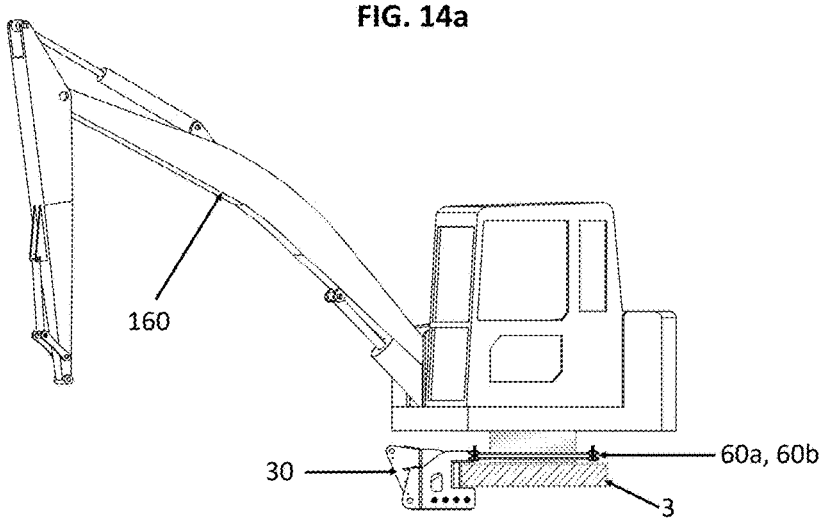

Next, a front or rear support structure is placed on the X-Frame. This is typically done using a forklift or similar suited lifting machine. In FIG. 14*b*, the front support structure 30 is lifted in place over the X-Frame 3 (shaded). The support structure should rest in place in a loose clamping fashion due to the 'clamp' feature of the support structure as shown in FIG. 14*b*.

One end of the upper connector struts 60*a* and 60*b* can be connected as shown in FIG. 14*b* at this stage, or following either of the next two steps (after installing either the lower support structure or the rear support structure), with the estimated number of horizontal shims (or wedge shims depending on the invention mode being installed) inserted at that end.

Next, in the preferred mode, the lower support structure is lifted in place with vertical shims. This is important in the preferred mode inasmuch as lower support structure 50 has extensions that insert into the front and rear support structure such that the extensions at one end slide into the receptacles in the front and rear structures. Here, with the front support structure in place first, and after inserting the desired vertical shims on the lower support structure, extensions 51*a*, 51*b*, and 51*c* are inserted into receptacles 33*a*, 33*b*, 33*c*. Bolts 84*a* (FIG. 10*a*) are loosely inserted—as are their counterpart bolts on the opposite side (side 'b').

Figure 14C:
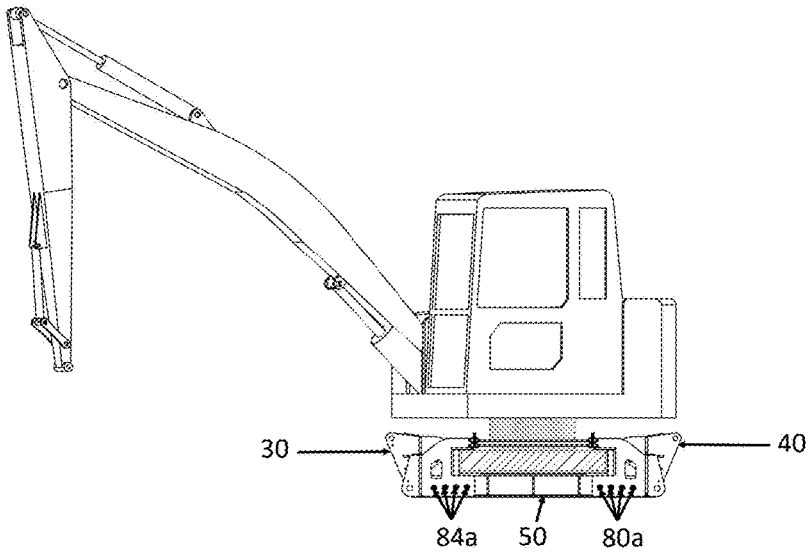

Next, using the forklift, install the opposite end support structure. In FIG. 14*c*, this is the rear support structure 40. Again, in the preferred mode, the extensions will be inserted into the receptacles as the support structure is lifted into place around the X-Frame. Here the extensions 52*a*, 52*b*, 52*c* are inserted into receptacles 43*a*, 43*b*, 43*c*, with tightening bolts 80*a* and their counterpart bolts on the 'b' side loosely inserted.

If using the one piece mode in FIG. 13, these three steps of inserting the front support structure, the lower support structure and the rear support structure are eliminated and replaced with the steps of inserting the vertical shims, then lifting and sliding the one piece (110 in FIG. 13), with said vertical shims, into place around the X-Frame 3. Then proceed to the next step.

Next, insert the remaining shims. These are either horizontal shim plates or wedge shims depending on the mode used.

Next, insert upper connector struts, or tie rods, depending on the mode used (modes in FIG. 1*a*, FIG. 11*a*, FIG. 12*a*, or FIG. 13). In the preferred mode shown in FIG. 1*a*, if the upper connector struts 60*a*, 60*b* have not been previously placed by connecting to their front end as referenced above, they should be inserted now, and both ends connected to the front and rear support structures, respectively, after inserting the desired number of shims. A side view of the assembly at this stage is shown in FIG. 14*c*.

Next, evenly tighten all bolts at the foregoing locations surrounding the X-Frame to secure the invention to the X-Frame. Shims may be added or removed as needed.

Figure 14D:
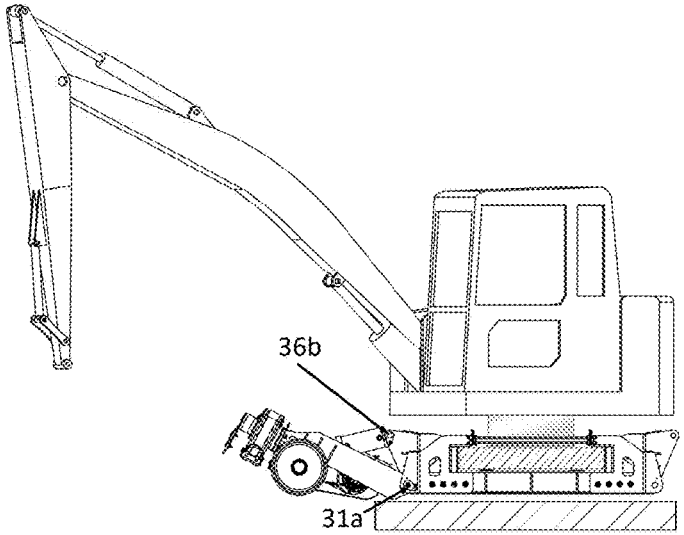

Next install one end of the high-rail Apparatus. In FIG. 14*d* this is shown as the front high-rail apparatus after being lifted in place with a forklift. All connections are made to the respective brackets 31*a*, 31*b* and 32*b*.

Figure 14E:
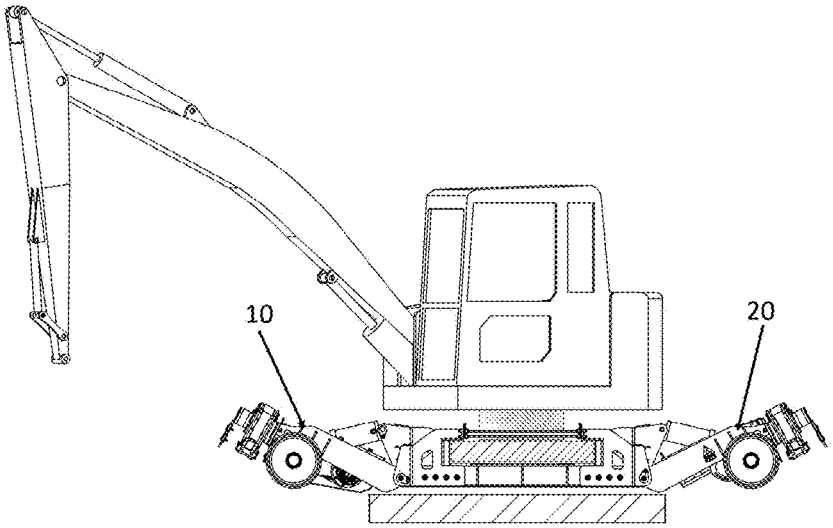

Next install the other end high-rail apparatus. In FIG. 14*e*, the rear High-rail apparatus is shown in this step. This is done in the same manner as the front high-rail apparatus was installed, in this case connecting to the brackets 41*a*, 41*b*, and 42*a*.

Next attach the other end of the hydraulic lines that were capped to the invention hydraulics. These may be the individual locations at each cylinder, or to a bulkhead placed on the invention to which all individual locations are pre-connected.

Next check for leaks. Then track off the cribbing utilizing the crawler tracks, with rail apparatus at both ends up and disengaged from the rails below.

Figure 14F:
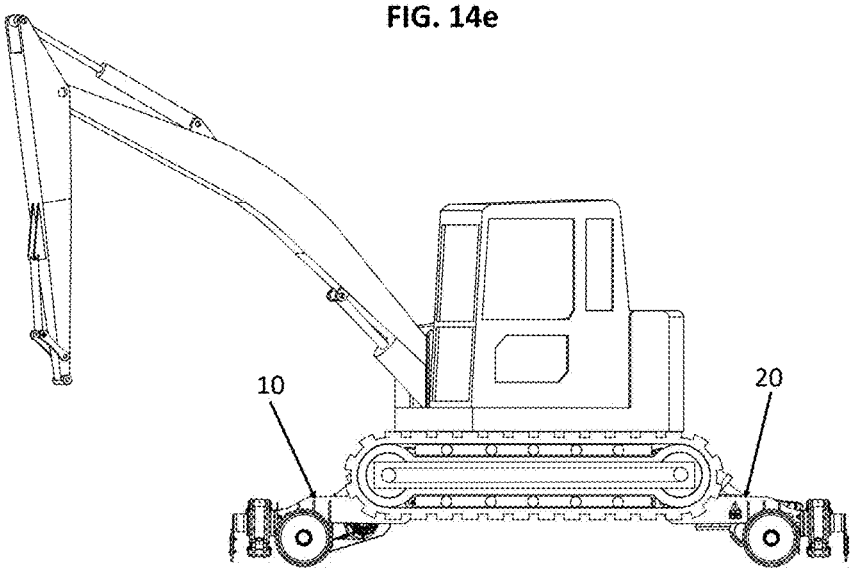

The invention is now installed, ready to lower said rail apparatus to engage the rails as shown in FIG. 14*f*, to provide a rail-based mobilization in lieu of the ground-based crawler tracks.

The entire unit is now ready to operate as an excavator on rails. The controls in the cab are now connected through the rotary hydraulic manifold via diverting valves to control all the needed functions, such as the invention brakes, clamps, and raising and lowering any invention cylinders. Drive motors can be controlled by the operator to move the unit forward and backward on the track.

When ready to do the task of excavating, the operator can energize the clamps 18*a* and 18*b* through their respective cylinders so that the clamps grab on to the rails firmly for support. The rail wheels, if not already on the railroad rails, will be lowered to the rails by energizing the hydraulic cylinders 15 and 25 of both the front and rear rail apparatus respectively by extending the said cylinders to lower said front and rear rail apparatus to the rails sufficiently to also lift the entire cab assembly above the railroad rails.

What is disclosed is a unique device and method for relatively easily converting a typical large excavator or similar crawler based machine having an X-Frame type or similar planar structure to removably attach to with no front and rear obstructive attachments, to a high-rail device capable of heavy duty excavating on and from railroad tracks, while maintaining the ability to use the same device off-rail utilizing the crawler tracks, or drive wheels, with relative ease in conversion, all in a manner so as not to drill, weld, machine, or otherwise cut into, penetrate, or damage the X-Frame or other original excavator parts, by pressure enveloping the X-Frame in a non-invasive manner to create the primary physical retention means, so as to pressure retain the X-Frame in all directions and otherwise prevent any movement of the invention attachment with respect to the excavator, in any of the four directions of the X-Frame (top, bottom, front and rear, i.e. up, down, and to either side).

Other features and manner of accomplishing the invention as apparent from the disclosure herein are intended and claimed.

What is claimed is:

1. A rail drive system for reversibly converting a crawler mobilized machine from ground transport mobility to rail transport mobility in forward and rear directions on rails, where the machine is hydraulically operated using a hydraulic power source, and has a rigid X-Frame underneath as part of the machine, and where the X-Frame has four sides comprised of a top side and a bottom side relative to ground, and a front end side, and rear end side corresponding respectively to the forward and reverse direction of transport, the system comprised of:

a. Front end high-rail means having rail wheels and having powered wheel lifting means for raising and lowering rail wheels to and from the rails;

b. Rear end high-rail means having rail wheels and having powered wheel lifting means for raising and lowering rail wheels to and from the rails;

c. Clamp means for securing the front end high-rail means and rear end high-rail means to the rails;

d. Powered drive means on at least one of the two high-rail means for driving the rail wheels;

e. Releasable X-Frame pressure enveloping means attached to the front end and rear end high-rail means where such pressure enveloping means provides pressure to all four sides of the X-Frame for tightly grasping the X-Frame without substantially modifying the X-Frame.

2. The rail drive system in claim 1 where the releasable X-Frame pressure enveloping means is comprised of at least four members comprised of a front end rigid member attached to the front end high-rail means having engaging means for engaging the X-Frame top and bottom sides near the X-Frame front end, and rear end rigid member attached to the rear end high-rail means having engaging means to engage the X-Frame top and bottom sides near the X-Frame rear end, a bottom rigid member below the X-Frame bottom side and connected to the front end rigid member and the rear end rigid member, and at least one top rigid member above the X-Frame top side and connected to the front end rigid member and the rear end rigid member, and tightening means for tightening the four members together against the X-Frame.

3. The rail drive system in claim 2 where the front end rigid member, the rear end rigid member, and the bottom rigid member are permanently connected together as one piece.

4. The rail drive system in claim 3 where the tightening means is comprised of rigid wedge means releasably retained between the X-Frame and at least one of the rigid members so as to provide pressure vertically and horizontally against the X-Frame.

5. The rail drive system in claim 2 where the tightening means is comprised of rigid wedge means releasably attached between the X-Frame and at least one of the rigid members so as to provide pressure vertically and horizontally against the X-Frame.

6. The rail drive system in claim 1 where the releasable X-Frame pressure enveloping means is comprised of a front end rigid member, a rear end rigid member and front and rear wedge means, where the front end rigid member is attached to the front end high-rail means having top and bottom engaging means for engaging the X-Frame top and bottom sides near the X-Frame front end where the top engaging means has a rigid front extension that extends over the top side of the X-Frame so as to leave front wedge receiving space between the front extension and the X-Frame top side and where the front extension has front wedge retaining means therein for retaining the front wedge means in the front wedge receiving space, and where the rear end rigid member is attached to the rear end high-rail means having top and bottom engaging means for engaging the X-Frame top and bottom sides near the X-Frame rear end where the top engaging means has a rigid rear extension that extends over the top side of the X-Frame so as to leave rear wedge receiving space between the rear extension and the X-Frame top side and where the rear extension has wedge retaining means therein for retaining the rear wedge means in the rear wedge receiving space.

7. The rail drive system in claim 1 where the powered drive means is a hydraulic power system independently operated.

8. The rail drive system in claim 1 where the powered drive means is the hydraulic power source of the machine, and having hydraulic diverting valves to allow the hydraulic power source to power selected functions of the rail drive system.

9. The rail drive system in claim 1 where the powered drive means is electric.

10. A method for reversibly converting a land based machine having an X-Frame to a rail mobile machine for mobilization on rails, having front and rear wheel rail means for moving on rails where at least one of the said wheel rail means has powered rail drive means, and having powered wheel lifting means to raise and lower the front and rear rail wheel means to and from the rails and having powered clamp means to releasably clamp the wheel rail means securely to the rails, and having at least one rail system power source to provide power to at least one of the powered wheel lifting means and powered clamp means and at least one of the powered rail drive means, and where the X-Frame has a front end and a rear end and a top side and a bottom side, the method comprised of the steps of:

a. Attaching a rigid front member to the front end of the X-Frame so as to engage the front end of the X-Frame;

b. Attaching a rigid lower member having first and second opposing ends to the front end lower portion of the rigid front member and attaching the second end to the rear end lower portion of a rigid rear member;

c. Attaching the rigid rear member to the rear end of the X-Frame so as to engage the rear end of the X-Frame;

d. Attaching tightening means to the front and rear rigid members to allow for securely engaging the X-Frame vertically and horizontally;

e. Tightening the tightening means so as to securely engage non-invasively the X-Frame vertically and horizontally between the rigid front member and rigid rear member;

f. Pivotally attaching one wheel rail means to the rigid front or rigid rear member as desired;

g. Pivotally attaching the other wheel rail means to the other front or rear rigid member;

Connecting the rail system power source to at least one of the powered wheel lifting means, the powered clamp means, and at least one of the powered rail drive means.

11. A method for reversibly converting a land based machine having an X-Frame to a rail mobile machine for mobilization on rails, having front and rear powered rail means with powered rail wheels for moving on rails and having powered wheel lifting means to raise and lower the rail means to and from the rails and having powered clamp means to releasably clamp the powered rail means securely to the rails, a rail system power source to provide power to the front and rear powered rail means, and where the X-Frame has a front end and a rear end and a top side and a bottom side, the method comprised of the steps of:

a. Lifting the land based machine to raise it off ground;

b. Releasably attaching a single rigid non-invasive retaining means having an interior front end, an interior rear end and an interior bottom that together form an interior space, so as to engage the X-Frame within the interior space;

c. Rotatably connecting the front and rear powered rail means to the rigid non-invasive retaining means;

d. Attaching releasable rigid top securing means to the single rigid non-invasive retaining means on the top side of the X-Frame so as to releasably secure the X-Frame in a non-invasive manner both vertically and horizontally within the rigid non-invasive retaining means;

e. Connecting the front and rear powered rail means, the powered wheel lifting means, and the powered clamp means to the rail system power source so as to allow the two powered rail means to engage or disengage from the rails, and so as to allow movement of the machine to a desired position on the rails and to engage the clamps to the rails to secure the machine in a fixed position.

12. A rail drive system for reversibly converting a crawler mobilized machine from ground transport mobility to rail transport mobility in forward and rear directions on rails, where the machine is hydraulically operated using a hydraulic power source, and has a rigid X-Frame underneath as part of the machine, and where the X-Frame has four sides comprised of a top side and a bottom side relative to ground, and a front end side, and rear end side corresponding respectively to the forward and reverse direction of transport, the system comprised of:

a. Front end high-rail means having rail wheels and having powered wheel lifting means for raising and lowering rail wheels to and from the rails;

b. Rear end high-rail means having rail wheels and having powered wheel lifting means for raising and lowering rail wheels to and from the rails;

c. At least one powered drive means for driving at least one of the two high-rail means for driving the rail wheels;

d. Releasable X-Frame pressure enveloping means attached to the front end and rear end high-rail means where such pressure enveloping means is adjustable so as to provide sufficient pressure as desired to the X-Frame to prevent movement horizontally or vertically for tightly grasping the X-Frame without substantially modifying the X-Frame.

13. The rail drive system in claim 12 having rigid wedge means to provide adjustability of the pressure.

14. The rail drive system in claim 12 wherein the powered drive means is the machine hydraulic power source and having hydraulic diverting valves to allow the machine hydraulic power source to power selected functions of the rail drive system.

* * * * *